US007446779B2

(12) United States Patent
Ikeda et al.

(10) Patent No.: US 7,446,779 B2
(45) Date of Patent: Nov. 4, 2008

(54) COLOR SIGNAL CORRECTION APPARATUS, COLOR SIGNAL CORRECTION METHOD AND IMAGE DISPLAY APPARATUS

(75) Inventors: Takeshi Ikeda, Kanagawa (JP); Osamu Sagano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 155 days.

(21) Appl. No.: 10/788,282

(22) Filed: Mar. 1, 2004

(65) Prior Publication Data

US 2004/0189657 A1 Sep. 30, 2004

(30) Foreign Application Priority Data

Mar. 5, 2003 (JP) ..... 2003-059091

(51) Int. Cl.
*G09G 5/02* (2006.01)

(52) U.S. Cl. ..... 345/589; 345/590; 345/690; 345/77; 345/84; 345/83

(58) Field of Classification Search ..... 345/589, 345/619, 690, 214, 77, 63, 4; 382/167, 274; 348/609, 631, 644, 645, 712, 713
See application file for complete search history.

(56) References Cited

U.S. PATENT DOCUMENTS

| | | | | |
|---|---|---|---|---|
| 5,300,862 | A * | 4/1994 | Parker et al. | 315/169.1 |
| 5,384,601 | A * | 1/1995 | Yamashita et al. | 348/577 |
| 5,949,496 | A * | 9/1999 | Kim | 348/645 |
| 6,313,816 | B1 * | 11/2001 | Kojima et al. | 345/83 |
| 6,411,047 | B1 * | 6/2002 | Okazaki et al. | 315/312 |
| 6,990,234 | B2 * | 1/2006 | Kanai | 382/167 |
| 2003/0107542 | A1 * | 6/2003 | Abe et al. | 345/89 |
| 2004/0104923 | A1 | 6/2004 | Koyama | 345/697 |

FOREIGN PATENT DOCUMENTS

| | | | |
|---|---|---|---|
| JP | 54105428 | * | 8/1979 |
| JP | 63-160492 | | 7/1988 |
| JP | 3-159392 | | 7/1991 |
| JP | 5-27711 | | 2/1993 |
| JP | 2002-75833 | | 3/2000 |
| JP | 2001-119717 | | 4/2000 |
| KR | 2002-0020173 | | 3/2002 |

* cited by examiner

*Primary Examiner*—Kee M. Tung
*Assistant Examiner*—Jwalant Amin
(74) *Attorney, Agent, or Firm*—Fitzpatrick, Cella, Harper & Scinto

(57) ABSTRACT

A color signal correction apparatus, for suppressing variation of a chromaticity point of achromatic color in a display apparatus, equipped with independent luminescent characteristic correction units respectively for each color for correcting a luminescent characteristic of luminance of respective RGB colors, an offset value for use in chromaticity correction, for suppressing variation of a chromaticity point of a simple color and a white color, which is defined in accordance with a luminance level is selected or generated based on one or two color data selected from respective RGB colors inputted into the correction unit, and the value is added to one color data selected from remaining one or two colors, and inputted into that color's correction unit, and thereby, it becomes possible to produce a color signal for suppressing variation of the chromaticity point, and to suppress variation of a chromaticity point of a simple color and an achromatic color.

17 Claims, 16 Drawing Sheets

COLOR SIGNAL CORRECTION APPARATUS, COLOR SIGNAL CORRECTION METHOD AND IMAGE DISPLAY APPARATUS

BACKGROUND OF THE INVENTION

1. Field of the Invention

This invention relates to an image display apparatus, a color signal correction apparatus and a color signal correction method which are used for the image display apparatus, and is one which is preferable when it is used for, in particular, a television receiver, a display apparatus and so on, which receive television signals, image signals for a computer and so on, and which display images by use of an indicator such as a plasma display panel (PDP), an electroluminescence display (ELD), an electron-emission type display and so on.

2. Description of the Related Art

Speaking about such TV signals as in NTSC and HDTV which are image signals by way of example, they are figured out with a receiver which used a CRT as a target, and are outputted after a γ characteristic which the CRT has (non-linear characteristic of a luminance signal—light emission luminance characteristic) has been corrected in advance (called as γ correction).

However, there occurs such a phenomenon that light emission quantity of an indicator does not precisely correspond to a luminance level.

Taking one example, in case of an electron-emission type display, there may be shown such a saturation phenomenon that, when selection time of one pixel is lengthened by adoption of line sequential drive, in a multiple electron beam source which is of simple matrix wiring such as a cold cathode device, as a result of that, such time that a light emitter (phosphor) of one pixel is subject to electron beam irradiation is lengthened too much, and light emission quantity of the phosphor is made not to be in proportion to electron beam irradiation time. In this specification, this phenomenon is called saturation of a phosphor.

A level of this saturation is varied in accordance with a type of a phosphor, density of an electron beam, irradiation time of an electron beam, and so on.

And, when a saturation characteristic is varied in accordance with a material of the phosphor and a type of a color, color balance of an image to be displayed, in particular, a chromaticity point of an achromatic color (white color) does not become a desired value.

A technology for solving the suchlike problem is disclosed in, for example, Patent Document 1 (JP-A-2000-75833 gazette). A saturation characteristic in accordance with gradations of respective phosphors of RGB which were described in the patent document 1 is shown in FIG. 13. In FIG. 13, a horizontal axis indicates standardized luminance data, and a vertical axis indicates standardized luminance.

And, on one shown in FIG. 13, an inverse function (correction function) of a convex curve is calculated, and correction luminance data is calculated by substituting the correction function with input luminance data (also called luminance desired value, gradation data), and thereby, light emission luminance of the florescent body becomes linear to the input luminance data. And, RGB have that correction function, respectively, and thereby, saturation characteristics of respective phosphors can be corrected.

Other than this, an adjustment method of a white color has been proposed in Patent Document 2 (JP-A-63-160492 gazette), Patent Document 3 (JP-A-2001-119717 gazette), and so on.

However, in these conventional technologies, suppression of variation of chromaticity points of an achromatic color and a chromatic color is not sufficient.

For example, in a method for correcting an output luminance level to an input gradation level of a color signal as described in the patent document 1, correction of non-linearity of luminance becomes possible. However, it has not yet possible to suppress such a phenomenon that a chromaticity point of the achromatic color is varied interlocking with change of a gradation level. For details, if a chromaticity point of a white color in respective gradation levels after correction of saturation of phosphors was carried out, is shown on a CIExy chromaticity diagram, there may occur such a case that, interlocking with change of the gradation level, the chromaticity point of the white color is varied from a point 21 to a point 22, as measurement points shown in FIG. 14.

In this connection, an inventor of this invention has been studied with his whole heart with regard to this point, and proceeded with various researches, and as a result of that, learned that it is resulted from such a fact that there exist different saturation characteristics in all of tristimulus values XYZ, in a monochromatic gradation characteristic of phosphors of respective colors.

In particular, most of phosphors which are used in an indicator, as shown in FIG. 15, show such a gradation characteristic that Z in phosphors of red and green is close to a straight line, as compared with X, Y whose saturation characteristics are relatively similar to each other. In addition, in FIG. 15, a horizontal axis indicates standardized gradation data, and a vertical axis indicates standardized tristimulus value.

Therefore, as shown in FIG. 16, if correction is carried out by use of an inverse function of a saturation characteristic of Y as the correction function, even if a gradation characteristic of Y becomes linear, Z becomes over correction, and a gradation characteristic of Z becomes a downward convex characteristic. In addition, in FIG. 16, a horizontal axis represents standardized gradation data, and a vertical axis represents standardized corrected tristimulus value.

From FIG. 16, it is understood that, by such a fact that a Z component falls short relatively in red and green, balance of XYZ after correction, i.e., difference of a value of X or Y and a value of Z is varied in accordance with change of a gradation level, and thereby, a chromaticity point is varied even in a simple color which is a chromatic color. As a matter of course, in a white color of an achromatic color, in some gradation, only a component of Z is extremely reduced, and thereby, balance of XYZ components is disrupted, and therefore, values of x and y which are chromaticity coordinates of a white color are changed, and a chromaticity point of white is varied.

SUMMARY OF THE INVENTION

This invention is one which was made on the basis of the above-described new knowledge of the inventor of this invention, and its object is to provide a color signal correction apparatus and a color signal correction method in which display quality is improved by suppressing balance variation of tristimulus values XYZ in respective gradation levels, and by suppressing variation of a chromaticity point of a simple color interlocked with change of a gradation level which is resulted from a saturation characteristic of a light emitter, or variation of a chromaticity point of a achromatic color, and an image display apparatus on which a color signal correction apparatus was mounted.

In order to accomplish the above-described object, a first invention of this invention is a color signal correction apparatus which is equipped with a luminescent characteristic correction means for applying correction processing for correcting light emission luminance characteristics of respective colors, to color signals of a plurality of colors which correspond respectively to a plurality of light emitters which emit lights in different colors, respectively, an offset value decision means for deciding an offset value for use in chromaticity correction for suppressing variation of a chromaticity point of a predetermined color which is interlocked with change of a luminance level of the color, on the basis of a luminance level of at least one color signal which is selected from inputted color signals of the plurality of colors, and an offset value addition means for adding the offset value to at least one remaining color signal.

A second invention of this invention is a color signal correction method which includes a step of applying correction processing for correcting light emission luminance characteristics of respective colors, to color signals of a plurality of colors which correspond respectively to a plurality of light emitters which emit lights in different colors, respectively, a step of deciding an offset value for use in chromaticity correction for suppressing variation of a chromaticity point of a predetermined color which is interlocked with change of a luminance level of the color, on the basis of a luminance level of at least one color signal which is selected from inputted color signals of the plurality of colors, and a step of adding the offset value to at least one remaining color signal.

In the first invention or the second invention, it is desirable that the offset value addition means (1) adds the decided offset value to at least one remaining color signal which was outputted from the luminescent characteristic correction means, on the basis of a luminance level of one or a plurality of color signals which are selected from the color signals of the plurality of colors which were outputted from the luminescent characteristic correction means, or (2) adds the decided offset value to at least one remaining color signal which is inputted into the luminescent characteristic correction means, on the basis of a luminance level of one or a plurality of color signals which are selected from the color signals of the plurality of colors which are inputted into the luminescent characteristic correction means.

Also, it is desirable that the offset value is a value which increases or decreases in a non-linear form, to increase of a gradation level of the color signal.

It is also desirable to further have a second offset value addition means for deciding a second offset value for suppressing variation of a chromaticity point of another color, on the basis of the offset value, and for adding it to a color signal to which the offset value is not added.

It is also desirable to further have an offset value adjustment means for carrying out adjustment of the offset value, in accordance with balance of luminance levels between the color signals of the plurality of colors.

It is also desirable to further have a prohibition means for prohibiting addition of the offset value, in case that it was judged that a color signal representing a simple color was inputted, as the color signals of the plurality of colors.

Also, the above-described invention is able to configure a color signal correction apparatus having a semiconductor integrated circuit for executing the above-described color signal correction method. Further, it is also desirable to utilize in the form of a design resource (IP) for realizing the above-described color signal correction method in a semiconductor integrated circuit.

Also, it is desirable for this invention to configure an image display apparatus which is equipped with the color signal correction apparatus according to the first invention, and an indicator for displaying an image by light emission of light emitters.

The image display apparatus is equipped with a matrix circuit which has a plurality of scanning wirings and a plurality of scanning wirings which are not in parallel with the plurality of scanning wirings, and a cold cathode device which is driven through the matrix circuit, and light emitters, preferably display an image by irradiation of an electron beam which is emitted from the cold cathode device.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Hereinafter, with reference to the drawings, preferred modes for carrying out this invention will be described in detail in an illustrative manner.

Figure 1:
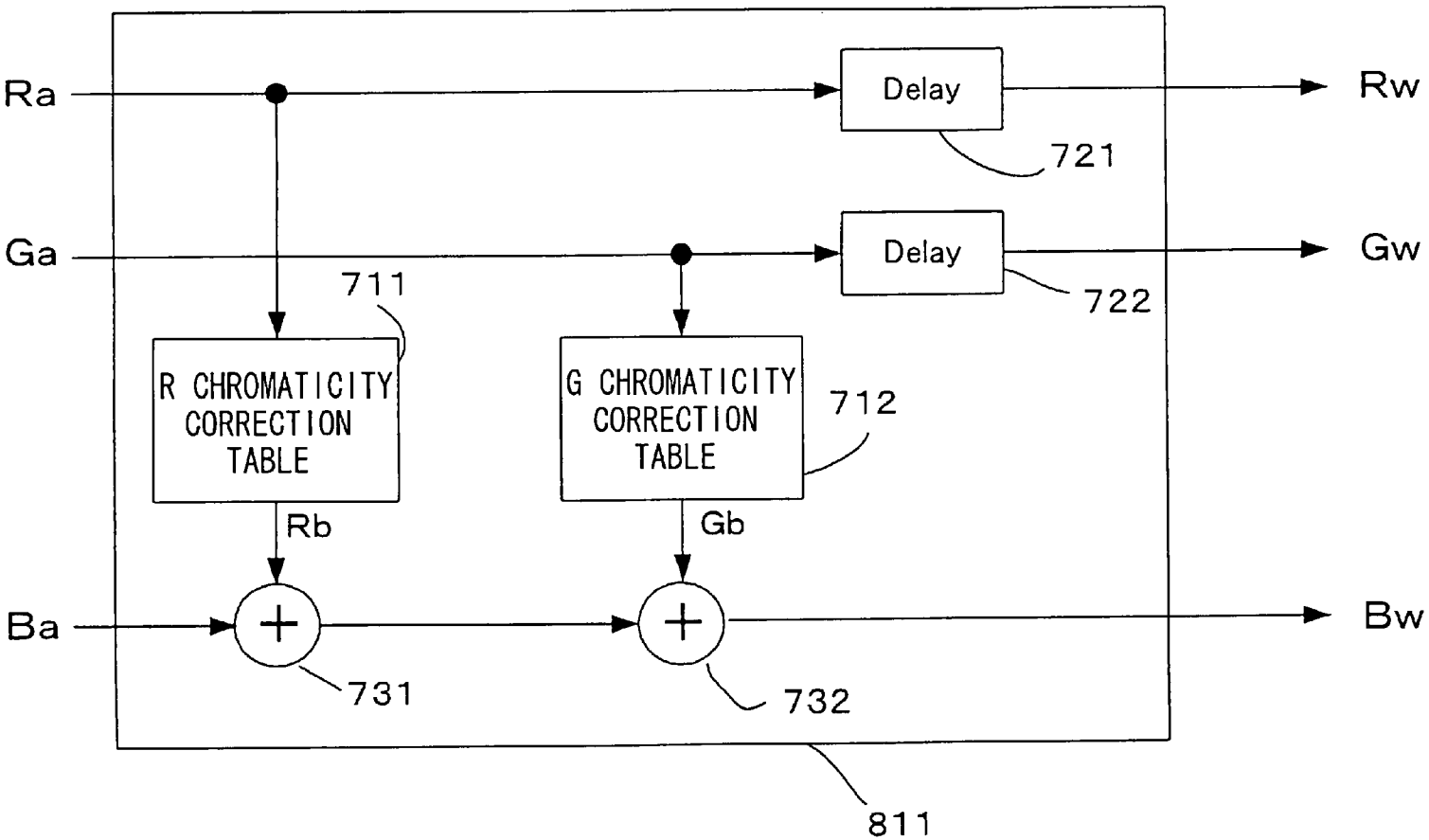
FIG. 1 is a view showing a structure of a chromaticity point correction unit in a first embodiment.
Figure 2:
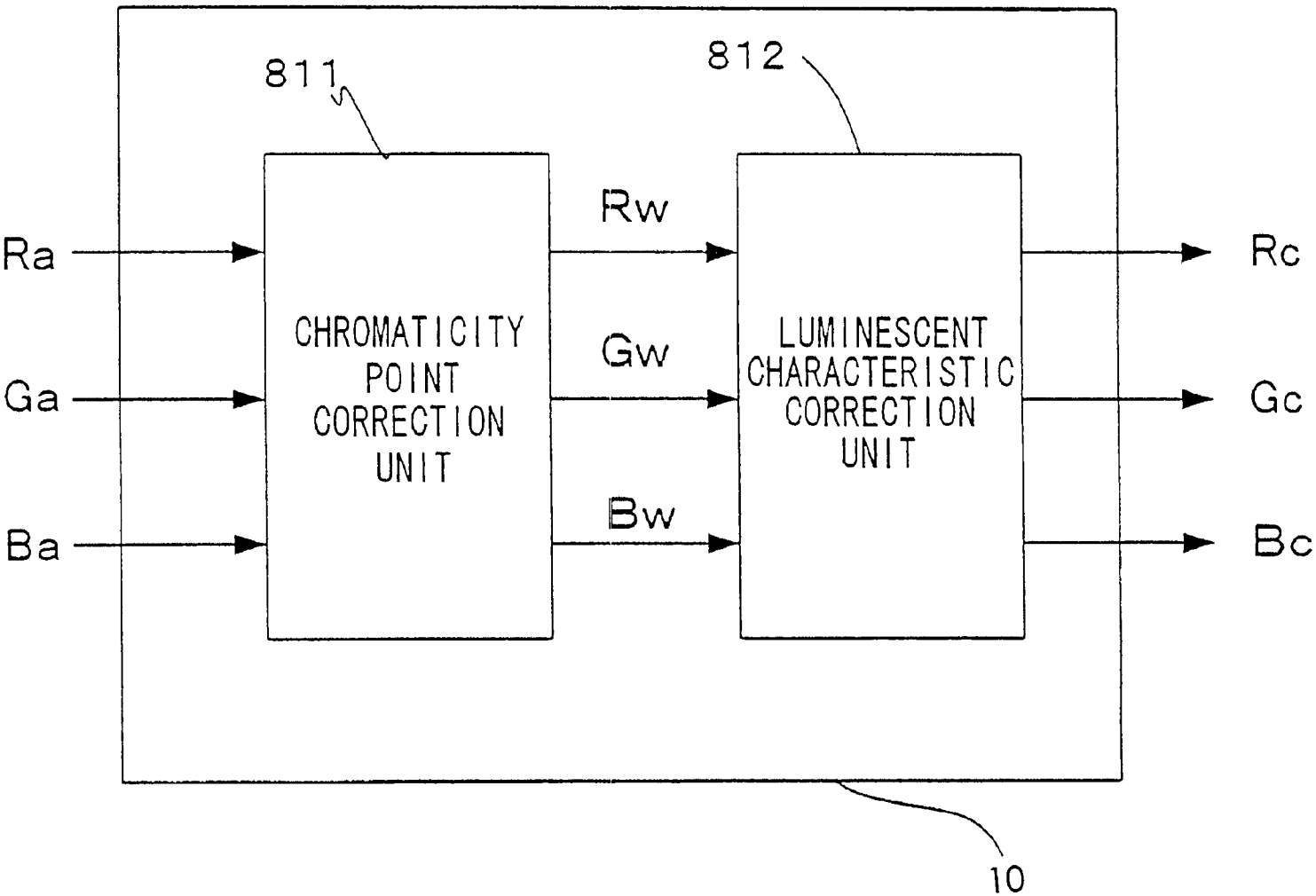
FIG. 2 is a block diagram of a color signal correction apparatus in the first embodiment.

FIGS. 1 and 2 show a color signal correction apparatus according to one embodiment of this invention.

As shown in FIG. 1, a color signal correction apparatus 10 is equipped with a luminescent characteristic correction unit (812) for applying, to color signals (Ra, Ga, Ba) of a plurality of colors which correspond respectively to a plurality of light emitters which emit lights in different colors, respectively, correction processing for correcting light emission luminance characteristics of the respective colors.

And, the color signal correction apparatus 801 has an offset value decision units (711, 712) for deciding offset values (Rb, Gb) for use in chromaticity correction, for suppressing variation of a chromaticity point of a predetermined color which was interlocked with change of a luminance level of the color such as a white color, on the basis of a luminance level of at least one color signal (Ra, Ga) which is selected from inputted color signals of a plurality of colors, and an offset value addition units (731, 732) for adding the offset values (Rb, Gb) to at least one remaining color signal (Ba).

As an indicator to which this invention is applicable, it is possible to cite an indicator in which a field emission type or a surface conduction type cold cathode device is combined with phosphors which emit lights when they receive electrons as light emitters, an indicator in which an organic EL device or an inorganic EL device is used as a light emitter, a plasma indicator which was equipped with phosphors which emits lights when they receive ultraviolet rays as light emitters, and so on.

As the luminescent characteristic correction unit 812, desirably used is one for correcting saturation of phosphors, i.e., a non-linear type correction circuit which corrects in such a manner that light emission luminance to a luminance level of an input color signal to an indicator becomes linear, by changing a luminance level of an output color signal to a luminance level of an input color signal, in accordance with the luminance level.

As a color which is capable of suppressing variation of a chromaticity point, it is not limited to a white color which is an achromatic color, but may be another color such as a green color, a red color, a blue color, and so on which are chromatic colors. Also, as a color signal which provides a luminance level which becomes a parameter for deciding the offset value, in FIG. 1, both of a red color signal and a green color signal were used, but any one of them may be used.

For example, in case of suppressing variation of a chromaticity point of the green color, on the basis of a luminance level of a green color signal (Ga), decided is an offset value (Gb) which is added to a blue color signal (Ba). In the same manner, in case of suppressing variation of a chromaticity point of the red color, on the basis of a luminance level of a red color signal (Ra), decided is an offset value (Rb) which is added to the blue color signal (Ba). Also, in case of suppressing variation of a chromaticity point of the blue color, on the basis of a luminance level of the green color signal (Ga)(in this case, 0 level), decided is the offset value (Gb) which is added to a blue color signal (Ba).

And, in case that an offset value (first offset value) which was decided on the basis of another color signal was added to the blue color signal (Ba), X becomes strong next to Z, out of tristimulus values. On that account, in order to reduce this increased portion of X, it is desirable to add a negative offset value, as a second offset value, to a red color signal with much X. In this manner, if a luminance level of the red color signal is lowered, it is possible to suppress such a situation that a subtle color such as a flesh color, an orange color and so on becomes bluish. Also, it is desirable that the suchlike negative offset value is decided on the basis of the offset value which is added to the blue color signal.

In this manner, by adding the second offset value which was decided on the basis of the first offset value by the second offset value adding unit to a color signal to which the first offset value is not added, it is possible to suppress variation of a chromaticity point of another color.

As the offset value adding unit which is used in this invention, the offset value which was decided on the basis of a luminance level of one or a plurality of color signals which are selected from color signals of the plurality of colors which are inputted into the luminescent characteristic correction unit is added to at least one remaining color signal which is inputted into the luminescent characteristic correction unit. Or, the offset value addition unit may add the offset value which was decided on the basis of the luminance level of one or the plurality of color signals which are selected from the color signals of the plurality of colors which were outputted from the luminescent characteristic correction unit to at least one remaining color signal which was outputted from the luminescent characteristic correction unit.

As the offset value which is used in this invention, it is desirable to be a value which increases or decreases in a non-linear form, in accordance with increase of a gradation level of a color signal.

Also, for example, it is desirable to carry out adjustment of the offset value, in accordance with balance of a luminance level between color signals of the plurality of colors, by disposing an offset value adjustment unit such as a multiplier. This produces an advantage in variation suppression of a chromaticity point which is interlocked with change of a gradation level, in a subtle color such as an orange color, a peach color, and a flesh color.

Also, in case that a color reproduction range is not wished to be changed, a judgment unit for judging an input of a color signal showing a simple color, as a plurality of color signals, is disposed by being configured by a comparator, a logic gate and so on, and in case that it was judged that it is a simple color, it is desirable to dispose a prohibition unit for prohibiting addition of the offset value by being configured by a logic gate and so on.

Also, in the above-described explanation, as a color to which the offset value is added, Z out of the tristimulus values was focused on, but according to a type of a phosphor, there is such a case that X or Y differs as compared with another stimulus value component. In this case, it is possible to change in such a manner that the offset value is added to color signals of red and green.

Hereinafter, a structure which used a cold cathode device, in particular, a surface conductive type electron-emitting device and phosphors, as an indicator will be described as an example.

First Embodiment

In the first embodiment, by a chromaticity point correction unit which selects the offset value in accordance with respective image data of R and G, and adds that offset value to image data which comprises a color signal of B, so as to stabilize balance of tristimulus values XYZ from a value of input image data which comprises color signals of R and G, and a luminescent characteristic correction unit which carries out saturation correction in accordance with a saturation characteristic of light emission luminance of respective phosphors, to image data which was outputted from the chromaticity point correction unit, balance of tristimulus values XYZ of a simple color is stabilized regardless of gradation, and correction for suppressing variation of a chromaticity point of a preferred color, in particular, an achromatic color is carried out.

And, in a display apparatus having a multiple electron sources in which a plurality of cold cathode devices, in this first embodiment, a plurality of surface conduction type electron-emitting devices were arranged at intersection points on a simple matrix by a plurality of scanning wirings and modulation wirings, by incorporating this color signal correction apparatus in an image display apparatus for displaying TV signals on a display panel having phosphors which emit lights when they receive electron beam irradiation from the multiple electron sources, it is possible to configure an image display apparatus for carrying out preferable image display.

Hereinafter, a structure of hardware of a color signal correction apparatus which is a feature of this invention and an image display apparatus which was mounted on the color signal correction apparatus will be described.

(Functional Explanation of Entire System and Each Portion)

Since, with regard to an overview of a display panel in an image display apparatus regarding respective embodiments of this invention, an electrical connection having a simple matrix structure, and a characteristic of a surface conduction type electron-emitting device, they are described in the patent document 1, explanations will be omitted here. In addition, with regard to an image display apparatus of this first embodiment, image display was carried out by line sequential drive and pulse width modulation unit.

Figure 3:
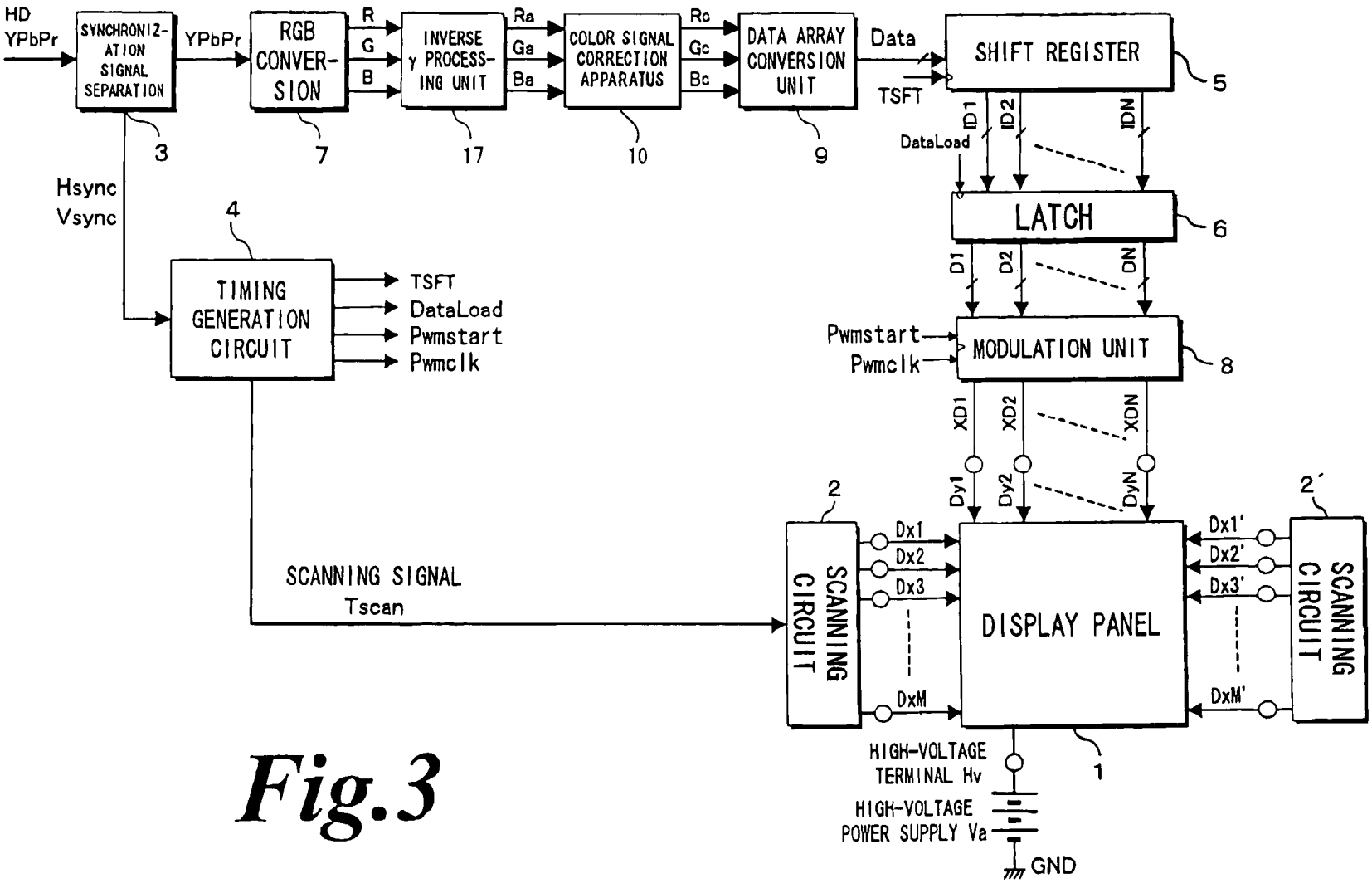
FIG. 3 is a block diagram showing a schematic structure of an image display apparatus of a first embodiment in which the color signal correction apparatus was incorporated.

Next, a structure of hardware is shown in FIG. 3. FIG. 3 is a block diagram showing an outline of a circuit structure thereof.

Dxl to DxM and Dxl' to DxM' designate voltage supply terminals of scanning wirings of a display panel 1, and Dyl to DyN designate voltage supply terminals of modulation wirings of the display panel 1, and Hv designate a high-voltage supply terminal for applying an acceleration voltage between a face plate and a rear plate, and Va designates a high-voltage power supply, and 2 and 2' designate scanning circuits, and 3 designates a synchronization signal separation circuit, and 4 designates a timing generation circuit, and 7 designates a conversion circuit for converting a YPbPr signal into a RGB signal, and 17 designates an inverse γ processing unit which is disposed according to need, and 10 designates a color signal correction apparatus of this invention, and 5 designates a shift register for one line of image data, and 6 designates a latch circuit for one line of image data, and 8 designates a pulse width modulation unit for outputting a modulation signal to modulation wiring of the display panel.

Also, in FIG. 3, R, G, B designate RGB parallel input image data, and Ra, Ga, Ba designate RGB parallel image data to which inverse γ conversion processing which will be described later was applied, and Rc, Gc, Bc designate RGB parallel image data which was corrected for suppressing variation of chromaticity points in the color signal correction apparatus 10, and for correcting saturation of phosphors, and Data designates image data which was parallel/serial converted by a data array conversion unit 9 which carries out conversion of a data array in alignment with a pixel array of the display panel 1.

With regard to an inputted image signal, firstly, by the synchronization signal separation circuit 3 shown in FIG. 3, synchronization signals Vsync and Hsync are separated therefrom, and then, supplied to the timing generation circuit 4. Synchronous separated image signal YPbPr is supplied to a RGB conversion unit. In the inside of the RBG conversion unit 7, other than a conversion circuit from luminance/color-difference signal YPbPr to an original color signal RGB, a low-pass filter, an A/D converter (both not shown) and so on are disposed, and the YPbPr signal is converted into a digital RGB signal, and then, supplied to the inverse γ processing unit 17.

The timing generation circuit 4 of FIG. 3 is a circuit which generates timing signals which correspond to various video formats, and generates operation timing signals of each part. As the timing signal which the timing generation circuit 4 generates, there are a control signal Dataload for latching data in the latch circuit 6, a pulse width modulation start signal Pwmstart of the modulation unit 8, clock Pwmclk for pulse width modulation, Tscan for controlling an operation of the scanning circuit 2, TSFT, and so on.

The scanning circuits 2 and 2' of FIG. 3 are circuits which output an selection electric potential Vs or a non-selection electric potential Vns to connection terminals Dxl to DxM, in order to sequentially scan the display panel one line by one line during one horizontal scanning period.

The scanning circuits 2 and 2' are circuits which sequentially switch selected scanning wiring with respect to each one horizontal period, in synchronous with the timing signal Tscan from the timing generation circuit 4, and which carry out scanning.

In addition, Tscan designates a timing signal group which is made from a vertical synchronization signal, a horizontal synchronization signal and so on.

Next, the inverse γ processing unit 17 described in FIG. 3 will be explained.

CRT has a luminescent characteristic of 2.2 power to an input (hereinafter, referred to as inverse γ characteristic). With regard to an input image signal from TV broadcasting waves, the suchlike characteristic of CRT is taken into consideration, and it is generally converted so as to have a γ characteristic of 0.45 power, in order to realize a linear luminescent characteristic on the occasion that it is displayed on CRT.

On one hand, since the display panel 1 of the image display apparatus which relates to a mode for carrying out this invention has a substantially linear luminescent characteristic to time to be applied, like a case of applying modulation in accordance with time for applying a drive voltage, and so on, the input image signal from TV broadcasting waves is converted into linearity of an image signal by calculating 2.2 power thereof. The suchlike conversion is called inverse γ conversion.

(Color Signal Correction Apparatus)

FIG. 2 is a block diagram of a color signal correction apparatus. In FIG. 2, 811 designates a chromaticity point correction unit, and 812 designates a luminescent characteristic correction unit.

In the chromaticity point correction unit 811, as described above, an offset value for carrying out chromaticity point correction is added to the image data Ra, Ga, and Ba, and image data Rw, Gw, and Bw which was obtained accordingly is outputted to the luminescent characteristic correction unit 812.

By the luminescent characteristic correction unit 812, an output luminance level to an input gradation level of the image data Rw, Gw, and Bw is changed, and phosphor saturation correction for correcting non-linearity of luminance is carried out. In this manner, image data Rc, Gc, and Bc, to which correction of variation of desired color, in particular, a white balance variation was applied, is generated.

(Chromaticity Point Correction Unit)

FIG. 1 shows a structure of the chromaticity point correction unit.

711 designates an R chromaticity correction table, and 712 designates a G chromaticity correction table. From the R chromaticity correction table 711 and the G chromaticity correction table 712, the offset values Rb and Gb, which are added to the blue image data Ba, are outputted, and added by adders 731 and 732, respectively. And, the blue image data Ba is outputted from the chromaticity point correction unit, as the image data Bw to which the offset value was added, and inputted into the luminescent characteristic correction unit 812.

Delay circuits 721 and 722 are ones which were disposed for preventing data to which the offset value is not added from going ahead, by time which is required for addition of the offset value to the blue image data Ba, and for adjusting output timing, and can be configured by use of a flip-flop and so on.

Figure 4A:
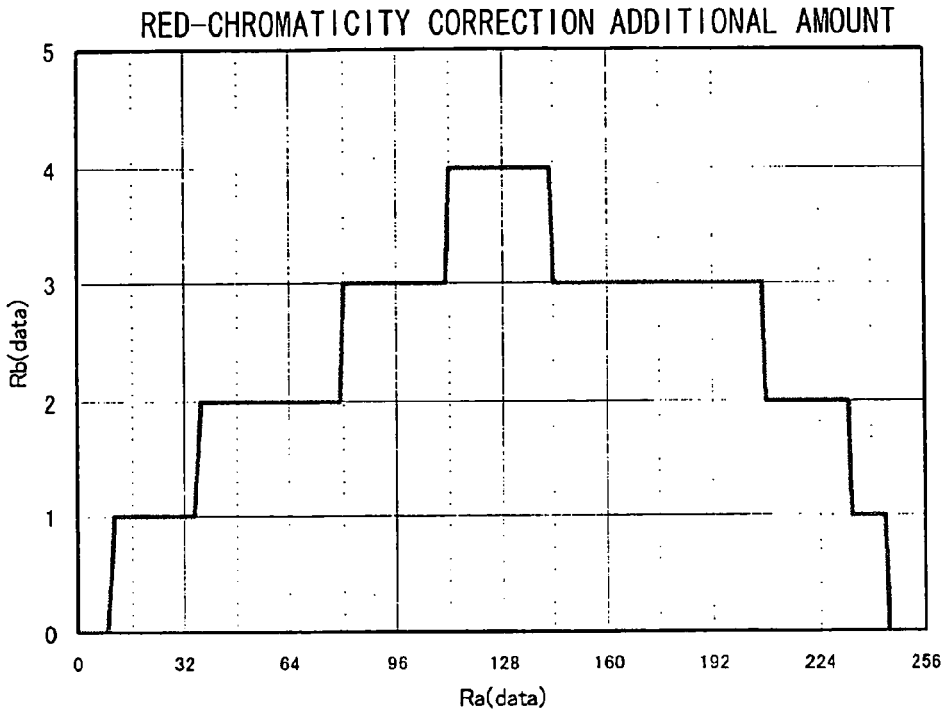
FIGS. 4A and 4B are views showing chromaticity point correction units in the first embodiment.

The R chromaticity correction table 711 outputs data Rb which becomes the offset value to be added to the blue image data Ba, on the basis of the red image data Ra. In the R chromaticity correction table 711, a value which increases and then decreases in a non-linear form, to increase of a gradation level, as shown in FIG. 4A, is stored. That is, the R chromaticity correction table 711 is a non-linear correction table to a gradating direction.

Figure 4B:
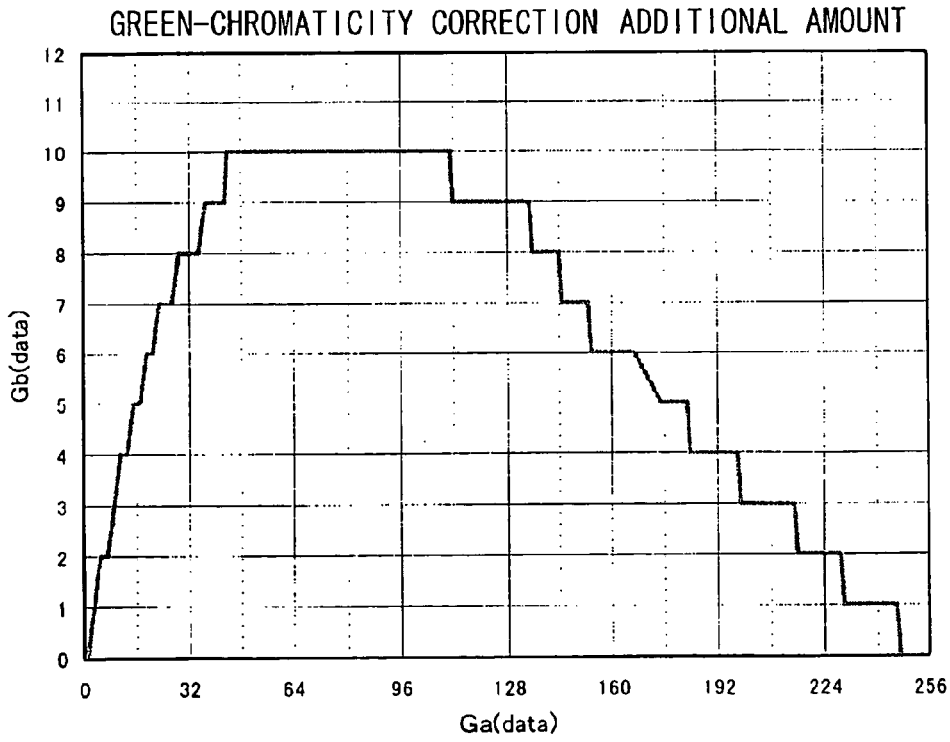

The G chromaticity correction table 712 outputs data Gb which becomes the offset value which is added to the blue image data Ba, on the basis of the green image data Ga. In the G chromaticity correction table 712, a value which increases and then decreases in a non-linear form, to increase of a gradation level, as shown in FIG. 4B, is stored. That is, the G chromaticity correction table 712 is a non-linear correction table to a gradating direction.

FIGS. 4A and 4B show input image data as a horizontal axis, and the offset value which is added to the blue image data as a vertical axis. Input/output is of 8 bit processing as an example.

Since the offset values of FIGS. 4A and 4B are of the same offset values in some adjacent gradation levels, the number of the offset values is suppressed.

Figure 5A:
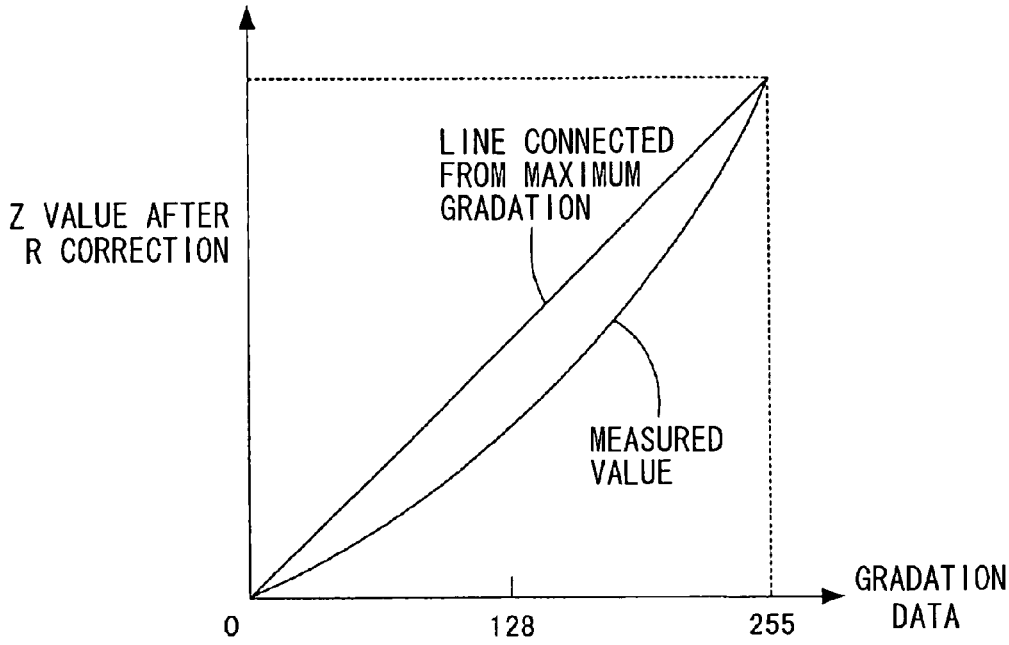
FIGS. 5A and 5B are views showing gradation characteristics of Z after saturation correction, of phosphors of red and green.

The offset value shown in FIG. 4A is calculated as follows. FIG. 5A shows a gradation characteristic of Z, out of tristimulus values XYZ of a red phosphor, after saturation correction of luminance. Also, a straight line is a straight line which is connected from a maximum gradation level to a minimum gradation level, and a downward convex curve shows measured values. And, a difference of the straight line and the measured value is calculated, and to what gradation level portion of the Z value of the blue phosphor, a value of the difference corresponds, is calculated with respect to each gradation level, and a table of the offset value which is non-linear to the gradation direction is prepared.

Figure 5B:
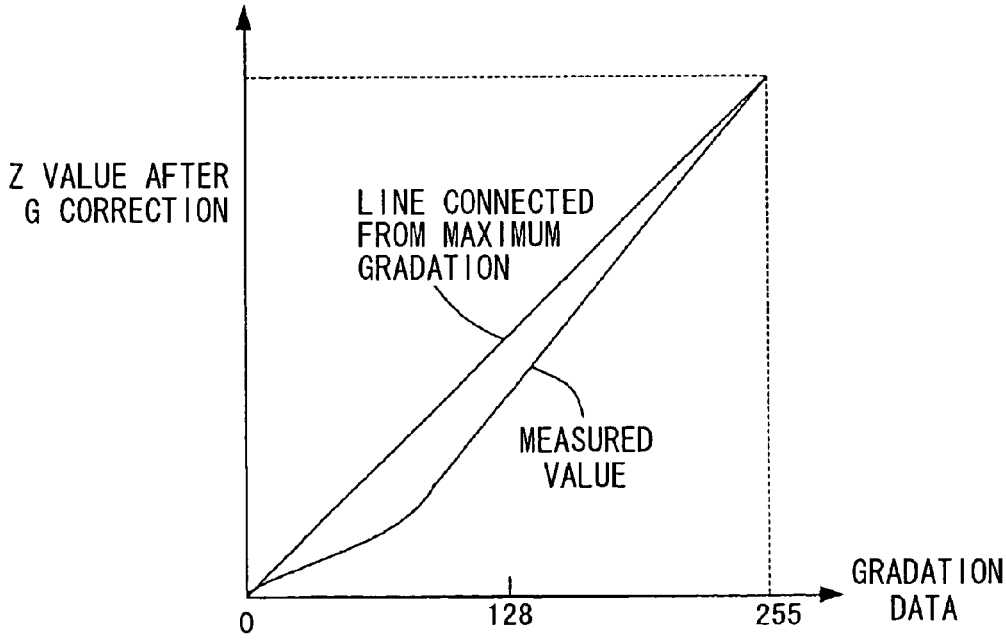

FIG. 5B shows a gradation characteristic of the tristimulus value Z of the green phosphor. With regard to the offset value of the green phosphor, by use of a similar method, a difference of the straight line and the measured value is calculated, and to what gradation level portion of the Z value of the blue phosphor, a value of the difference corresponds, is calculated with respect to each gradation level, and a table of the offset value which is non-linear to the gradation direction is prepared.

Figure 6:
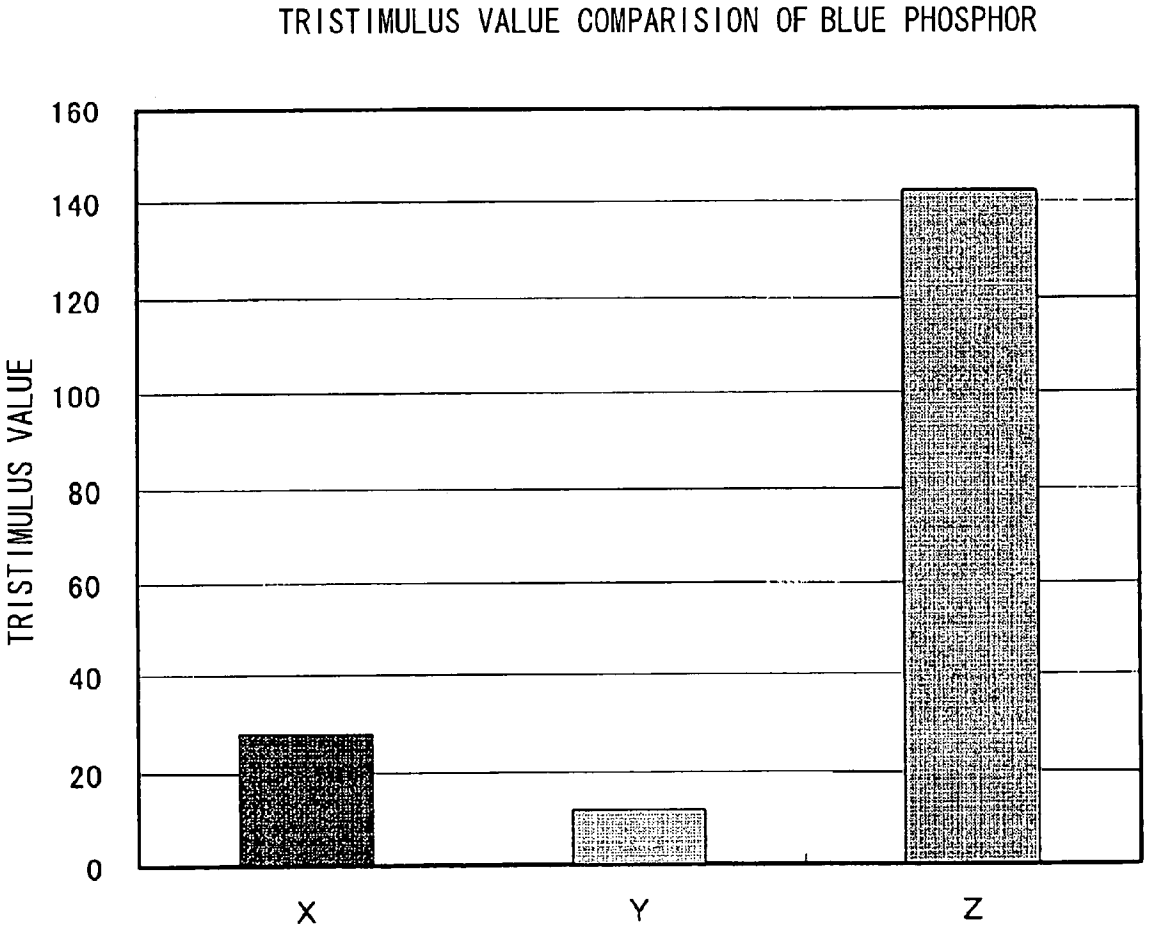
FIG. 6 is a view showing comparison of tristimulus value in a blue phosphor.

The phosphor which was used in this first embodiment is a phosphor for use in a color cathode ray tube which is now in practical use, and is known as a so-called P-22 phosphor. That is, as a green color light emitting phosphor, zinc sulfide phosphor with copper activator (ZnS:Cu) is used, and as a red color light emitting phosphor, oxysulfide yttrium phosphor with europium activator ($Y_2O_2S$:Eu) is used, and as a blue color light emitting phosphor, zinc sulfide phosphor with silver activator (ZnS:Ag) is used. In this phosphor, when the blue phosphor was made to emit light, a Z component is extremely large in any gradation, as compared with X and Y components. FIG. 6 shows a component value of tristimulus value of blue which is a light emission color. From FIG. 6, it is found that, in the blue phosphor, a component value of Z is extremely large as compared with X and Y. Therefore, by correcting a color signal so as to have the blue phosphor emitted light excessively, it is possible to compensate for shortage of the Z component.

(Luminescent Characteristic Correction Unit)

Figure 7:
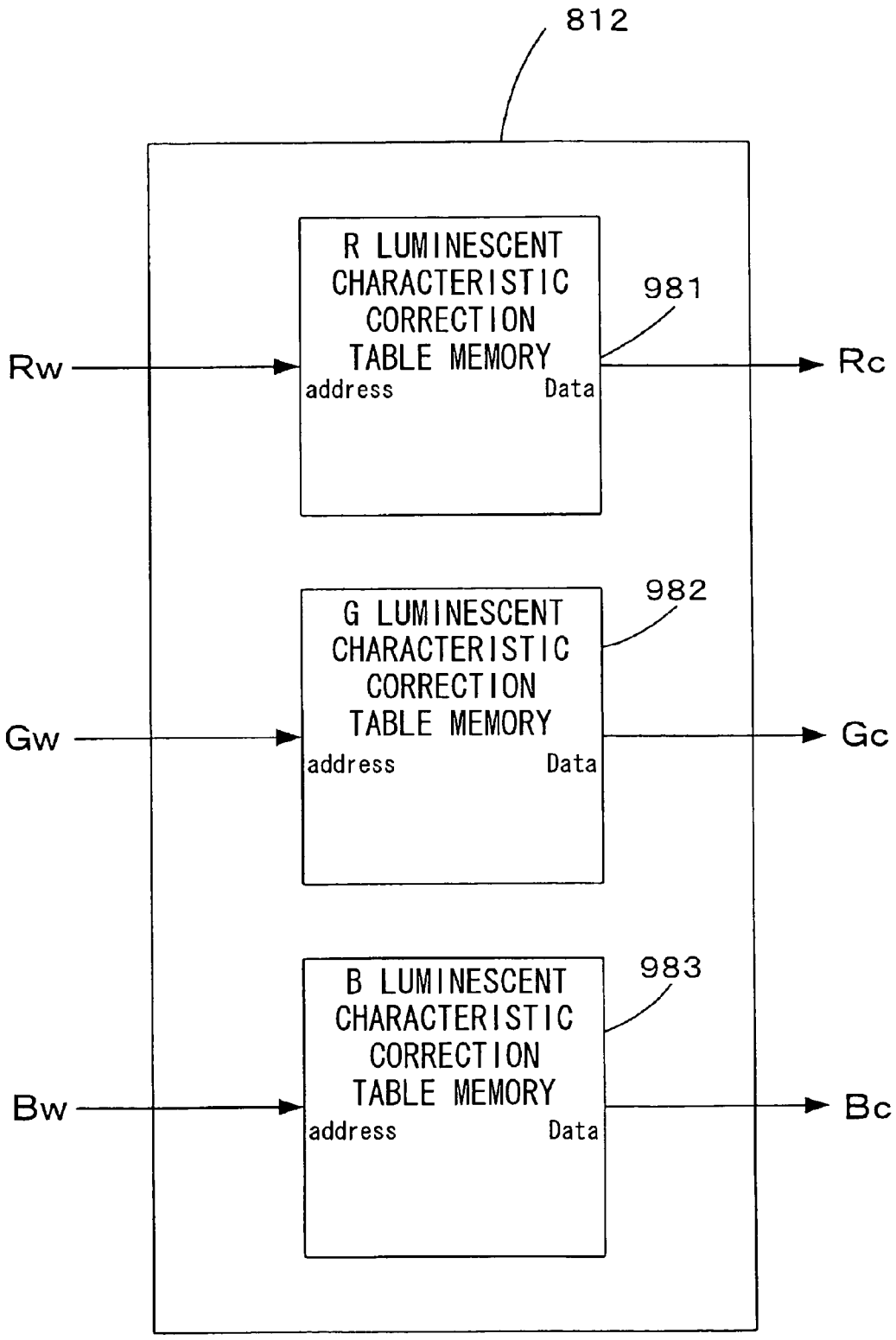
FIG. 7 is a view showing a structure of a luminescent characteristic correction unit.

A block diagram of the luminescent characteristic correction unit is shown in FIG. 7. The luminescent characteristic correction unit 812 is equipped with an R luminescent characteristic correction table memory 981, a G luminescent characteristic correction table memory 982, and a B luminescent characteristic correction table memory 983.

Figure 8A:
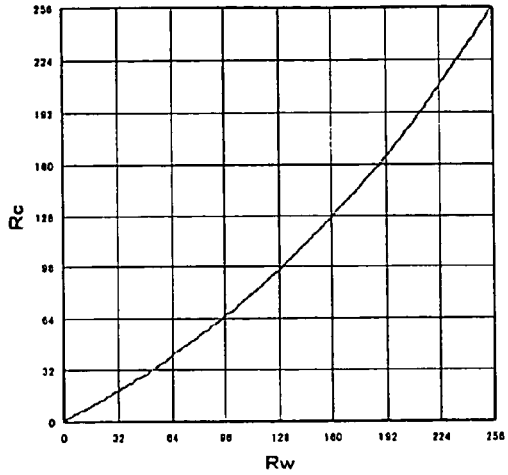
FIGS. 8A, 8B and 8C are views showing luminescent characteristic correction tables in the luminescent characteristic correction unit.

In the R luminescent characteristic correction table memory 981, stored is a table from which correction image data Rc is outputted, when image data Rw is inputted, as shown in FIG. 8A. FIG. 8A shows a characteristic of an inverse function of a function of a saturation characteristic of a phosphor, and by a correction table having a characteristic of this inverse function, a gradation characteristic of luminance of a red phosphor having the saturation characteristic becomes a linear gradation characteristic.

Figure 8B:
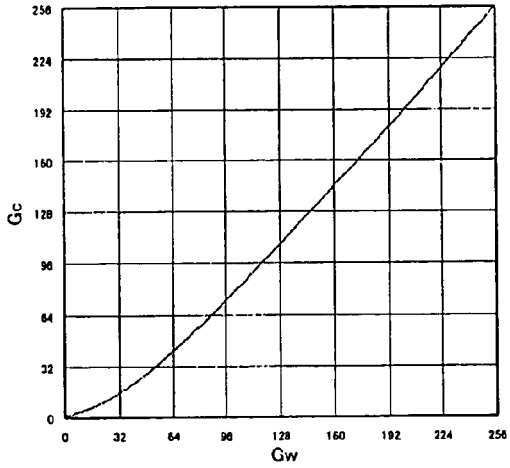

In the same manner, in the G luminescent characteristic correction table memory 982, stored is a table from which correction image data Gc is outputted, when image data Gw is inputted, as shown in FIG. 8B. FIG. 8B shows a characteristic of an inverse function of a function of a saturation characteristic of a phosphor, and by a correction table having a characteristic of this inverse function, a gradation characteristic of luminance of a green phosphor having the saturation characteristic becomes a linear gradation characteristic.

Figure 8C:
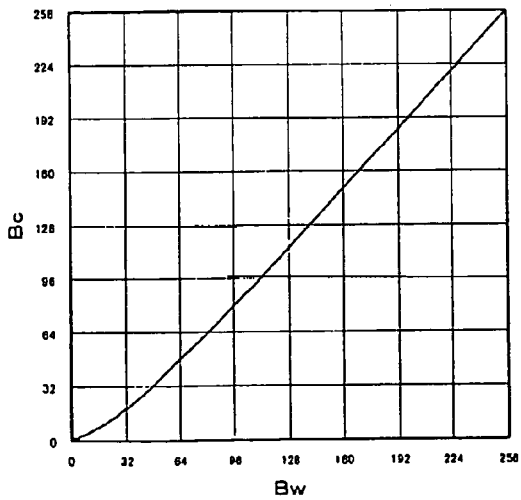

In the same manner, in the B luminescent characteristic correction table memory 983, stored is a table from which correction image data Bc is outputted, when image data Bw is inputted, as shown in FIG. 8C. FIG. 8C shows a characteristic of an inverse function of a function of a saturation characteristic of a phosphor, and by a correction table having a characteristic of this inverse function, a gradation characteristic of luminance of a blue phosphor having the saturation characteristic becomes a linear gradation characteristic. The tables of FIGS. 8A to 8C are not identical but different from one another, but each is a circuit for correcting so as to realize such a situation that a gradation characteristic of a phosphor having a saturation characteristic becomes a linear gradation characteristic.

In this manner, from the red and green image data, calculated is the offset value which is added to the blue image data for suppressing variation of a chromaticity point, and then, the offset value is added to the blue image data, and thereby, balance of the tristimulus values XYZ to a gradation direction of a simple color is stabilized, so that it is possible to suppress variation of chromaticity, and to suppress variation of a chromaticity point against a gradation direction of an achromatic color, and to prepare preferable image data (color signal).

In addition, since a luminescent characteristic of a phosphor is varied in accordance with a type of a phosphor, density of an electron beam, irradiation time of an electron beam, an acceleration voltage of a face plate and a rear plate, and so on, a content which is described in various correction tables used in the chromaticity point correction unit 811 and the luminescent characteristic correction unit 812 of the color signal correction apparatus 801 of this embodiment is not limited to these.

And, from the color signal correction apparatus 10, the output image data Rc, Gc, and Bc, which were corrected for suppressing variation of a chromaticity point, are outputted to the data array conversion unit 9 in FIG. 3.

The data array conversion unit 9 which is described in FIG. 3 has a function for sorting Rc, Gc, and Bc, which are RGB parallel image signals, in alignment with a pixel array of the display panel, and the RGB parallel image signal is outputted to the shift register 5 as serial image data S data of RGB. Although detail is not described, it is operated on the basis of a timing control signal from the timing generation circuit 4.

The image data Data, which is an output from the data array conversion unit 9 of FIG. 3, is converted from a serial data format into parallel image data ID1 to IDN with respect to each modulation wiring by the shift register 5, and outputted to a latch circuit. In the latch circuit, right before one horizontal period is started, by a timing signal Dataload, data from the shift register is latched. An output of the latch circuit 6 is supplied to the modulation unit 8 as parallel image data D1 to DN.

Figure 9A:
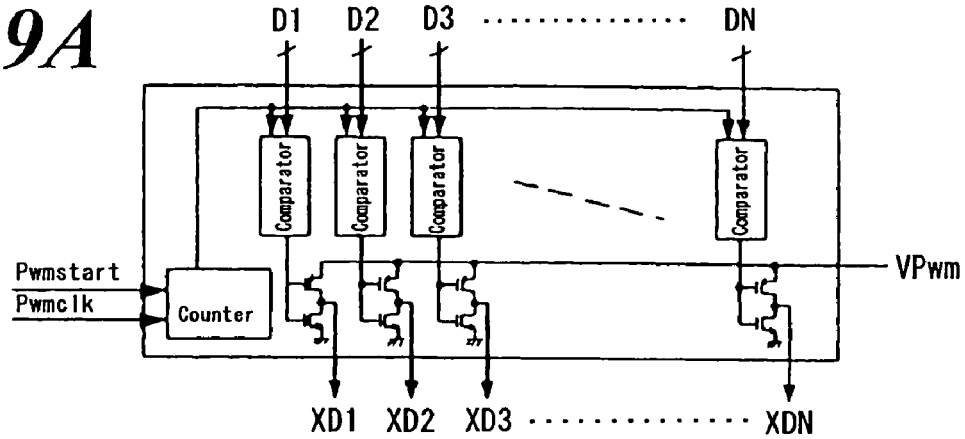
FIGS. 9A, 9B and 9C are views illustrating structure and operation of a modulation unit of an image display apparatus.

The modulation unit is, as shown in FIG. 9A, a pulse width modulation circuit (PWM circuit) which is equipped with a PWM counter, and a comparator and a switch (in the same figure, FET) with respect to each modulation wiring (VPwm being a voltage).

Figure 9B:
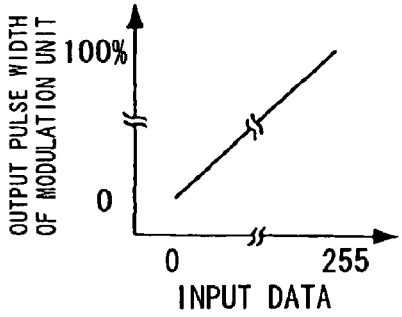

A relation of the image data D1 to DN and output pulse width of the modulation unit is of a linear relation as shown in FIG. 9B.

Figure 9C:
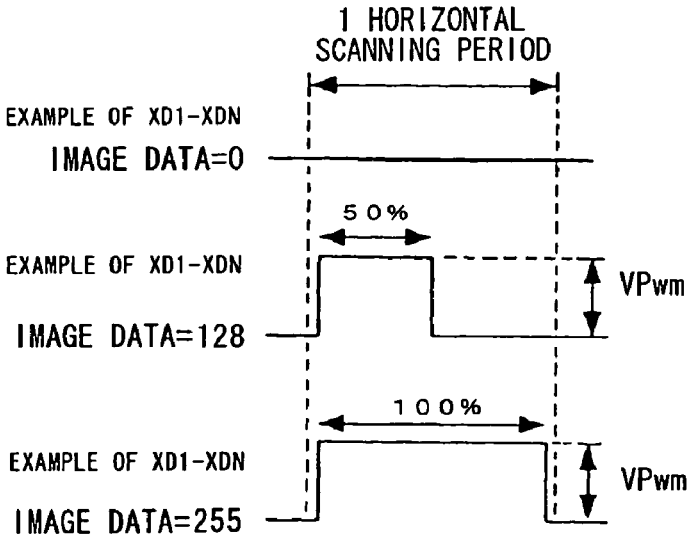

In FIG. 9C, three examples of output wave forms of the modulation unit are shown.

In the same figure, an upper wave form is a wave form when input data to the modulation unit is 0, and a central wave form is a wave form when the input data to the modulation unit is 128, and a lower wave form is a wave form when the input data to the modulation unit is 255.

In addition, in this embodiment, bit number of the input data D1 to DN of the modulation unit was made to be of 8 bit. Also, if an output voltage value and an output current value of the modulation unit is set so as to realize such a situation that an output luminance level of a phosphor becomes linear to the input data, a modulation method is not limited to the pulse width modulation, but may be a voltage amplitude modulation and a current amplitude modulation.

In the suchlike structure, the color signal correction apparatus is mounted, and display of an image is carried out, and as a result of that, in a gradation characteristic of a simple color and an achromatic color, which was a problem in the past, balance of the tristimulus values could be stabilized, and variation of a chromaticity point could be suppressed. Also, since a value of Y of the blue phosphor is small, out of the tristimulus values, a good characteristic could be obtained also as to a luminance characteristic. And, also as to a natural image, a good image could be obtained.

Also, according to a phosphor, by adding the offset value, another stimulus value of the tristimulus values XYZ becomes large, and therefore, another adjustment offset value to be decreased (second offset value) may be added not to blue color image data to be added but to red color image data, in accordance with the first offset values Rb and/or Gb to be added.

Second Embodiment

In the first embodiment, when image data of a simple color was inputted into the color signal correction apparatus, for example, even if a value of image data of another color except for green image data is 0, in accordance with a value of green image data, the offset value is added to blue image data and then, outputted, and image display is carried out, but in this case, there occurred such a case that a color reproduction range is varied slightly.

In this connection, in the second embodiment, a signal processing circuit for stabilizing balance of the tristimulus values XYZ of a simple color, regardless of gradation, and for carrying out correction for suppressing variation of a chromaticity point of a desired color, in particular, an achromatic color, i.e., a color signal correction apparatus is configured by a chromaticity point correction unit which selects the offset value in accordance with respective image data of R and G, so as to prevent deterioration of a color reproduction range of a simple color, when image data of a simple color was inputted, and so as to stabilize balance of the tristimulus values XYZ from values of the image data of R and G, when other image data than that was inputted to the color signal correction apparatus, and which adds that offset value to the image data of B, and a luminescent characteristic correction unit which carried out saturation correction in accordance with saturation characteristics of respective phosphors, to the image data which was outputted from the chromaticity point correction unit.

Figure 10A:
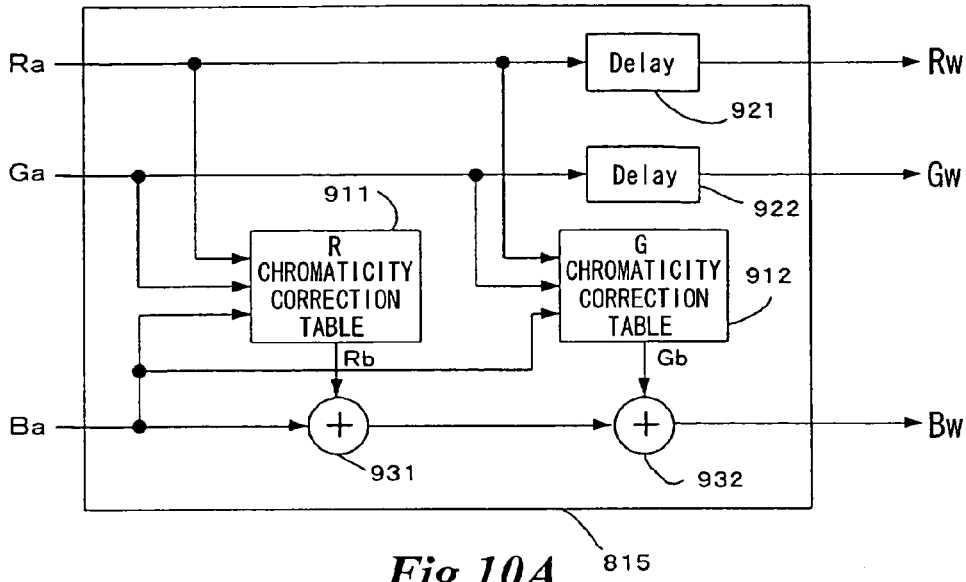
FIGS. 10A, 10B and 10C are views showing structure of a chromaticity point correction unit, in a second embodiment.

With reference to FIG. 10, the chromaticity point unit of the color signal correction apparatus in the second embodiment will be described. FIG. 10A shows a structure of the chromaticity point correction unit 815.

911 designates an R chromaticity correction table, and 912 designates a G chromaticity correction table. From the R chromaticity correction table 911 and the G chromaticity correction table 912, the offset data Rb and Gb, which are added to the blue image data Ba, are outputted, and added by adders 931 and 932, respectively. And, the blue image data Ba is outputted from the chromaticity point correction unit 815, as the image data Bw to which the offset value was added, and inputted into the luminescent characteristic correction unit 812, as shown in FIG. 2.

Delay circuits 921 and 922 are ones which delay an output of data by time which is required for addition of the offset value to the blue image data Ba, and can be configured by use of a flip-flop and so on.

Figure 10B:
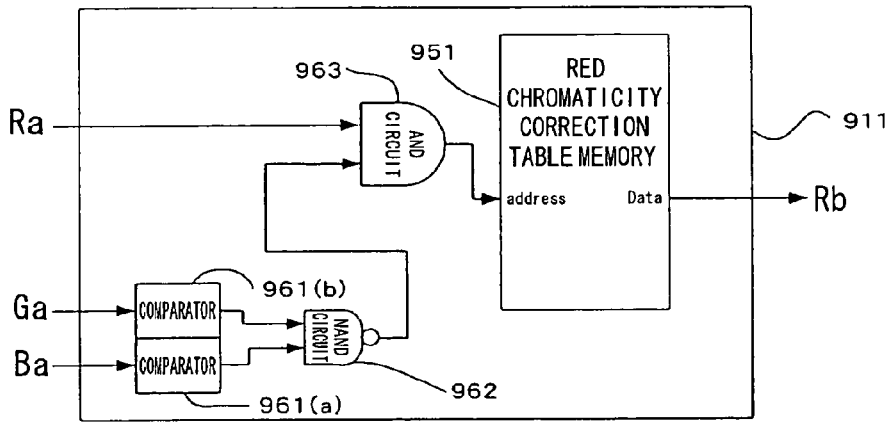

The R chromaticity correction table 911 is configured as shown in FIG. 10B. That is, the R chromaticity correction table 911 is configured by a RED chromaticity correction table memory 951, comparators 961(*a*) and 961(*b*), a NAND circuit 962, and an AND circuit 963. The RED chromaticity correction table memory 951 outputs data of the offset value which is added to the blue image data Ba, data Rb, on the basis of the red image data Ra.

In the RED chromaticity correction table 951, a table which is the same as in the first embodiment and shown in FIG. 4A, is stored, and the offset value Rb is changed in a non-linear form, to size of the red image data.

Also, in case of the image data of only a red simple color, nothing is added to the blue image data Ba, and therefore, in case that image data of other image data Ga and Ba than red was 0, the comparators 961(*a*) and 961(*b*) output a H level, and thus, an output of the NAND circuit 962 becomes a L level. As a result of this, in the AND circuit 968, L is inputted, and therefore, in case that image data of other image data Ga and Ba than red was 0, a value of 0 is inputted into the RED chromaticity correction table memory, and data Rb of the offset value becomes 0.

Figure 10C:
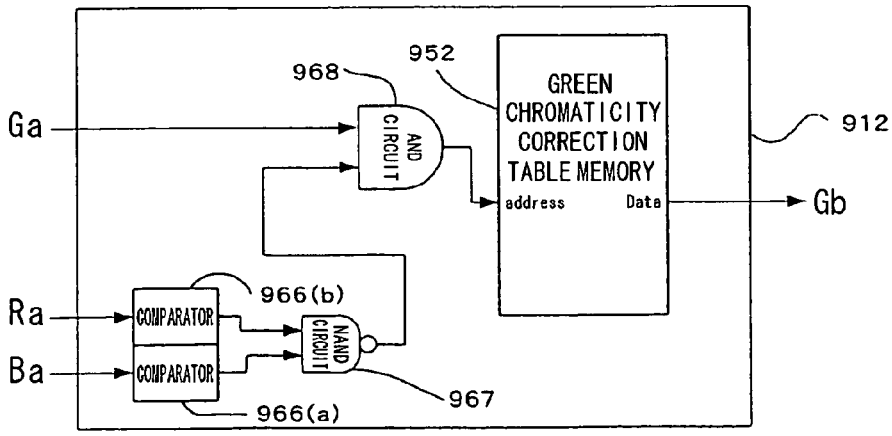

The G chromaticity correction table 912 is also configured as shown in FIG. 10C, in the same manner as in the R chromaticity correction table 911. The G chromaticity correction table 912 is configured by a GREEN chromaticity correction table memory 952, comparators 966(*a*) and 966(*b*), a NAND circuit 967, and an AND circuit 968. The GREEN chromaticity correction table memory 952 outputs data Gb which becomes the offset value to be added to the blue image data Ba, on the basis of the green image data Ga. In the GREEN chromaticity correction table 952, a table which is shown in FIG. 4B, is stored, and the offset value Gb is changed according to size of the green image data Ga.

Also, in case of the image data of only a green simple color, nothing is added to the blue image data Ba, and therefore, in case that image data of other image data Ga and Ba than green was 0, the comparators 966(*a*) and 966(*b*) output a H level, and thus, an output of the NAND circuit 967 becomes a L level. As a result of this, in the AND circuit 968, L is inputted, and therefore, in case that image data of other image data Ra and Ba than green was 0, a value of 0 is inputted into the GREEN chromaticity correction table memory, and data Rb of the offset value becomes 0.

In this manner, when image data of a simple color was inputted, by a judgment unit including a comparator and a NAND circuit, it is judged that image data is of a simple color, and as a result of that, by a prohibition unit including a AND circuit, an address input of the offset value to a memory is stopped, so that addition of the offset value to image data is prohibited. When other image data than that was inputted, by image data of phosphors of red and green, the offset value of a blue phosphor is calculated and then, added to blue image data, and a luminescent characteristic of a phosphor (saturation characteristic) is corrected to the added image data.

In this manner, since variation of a chromaticity point of a simple color is suppressed, and deterioration of a color reproduction range is prevented, and balance of the tristimulus values of an achromatic color with respect to each gradation level becomes substantially constant, it is possible to suppress variation of a chromaticity point.

The above-described color signal correction apparatus was mounted on an image display apparatus, in the same manner as in the first embodiment, and display of an image was carried out, and as a result of that, without narrowing a color reproduction range of a simple color, in a gradation characteristic of an achromatic color, which was a problem in the past, balance of the tristimulus values could be stabilized, and variation of a chromaticity point could be suppressed. Also, as to a luminance characteristic, a good characteristic could be obtained. And, also as to a natural image, a good image could be obtained.

Also, in this embodiment, described was such a structure that, in order to avoid narrowing the color reproduction range by addition of offset, when image data of a simple color was inputted, an offset amount is made to become 0. However, there may occur such a case that, when another color is slightly mixed with a simple color, hue is rapidly changed by addition of offset, as compared with a case of a simple color, it may be configured to prevent the rapid change of hue, by further multiplying the offset value with a gain, according to balance of image data of RGB.

Third Embodiment

Figure 11A:
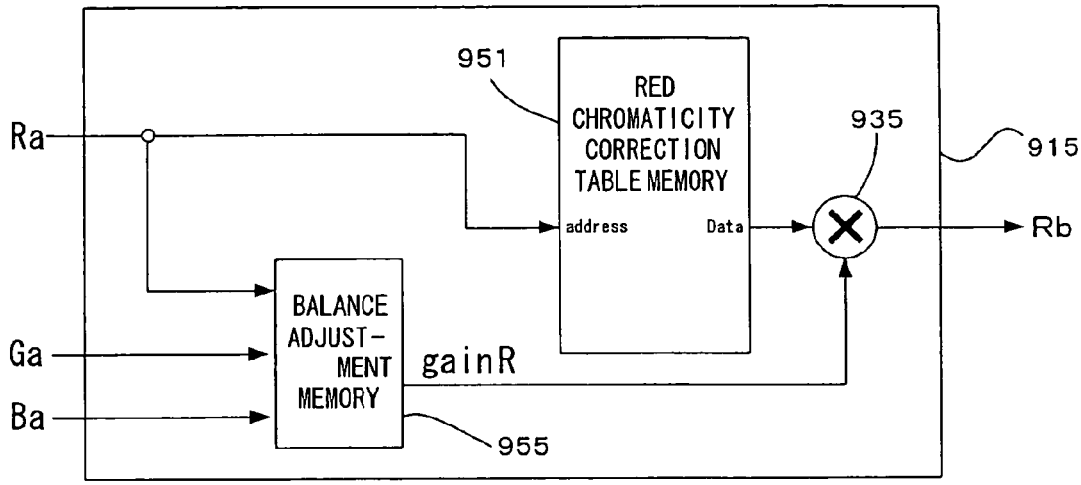
FIGS. 11A and 11B are views showing structure of a chromaticity correction unit for preventing a color reproduction range from becoming narrower, and for suppressing abrupt change of hue, in a third embodiment.
Figure 11B:
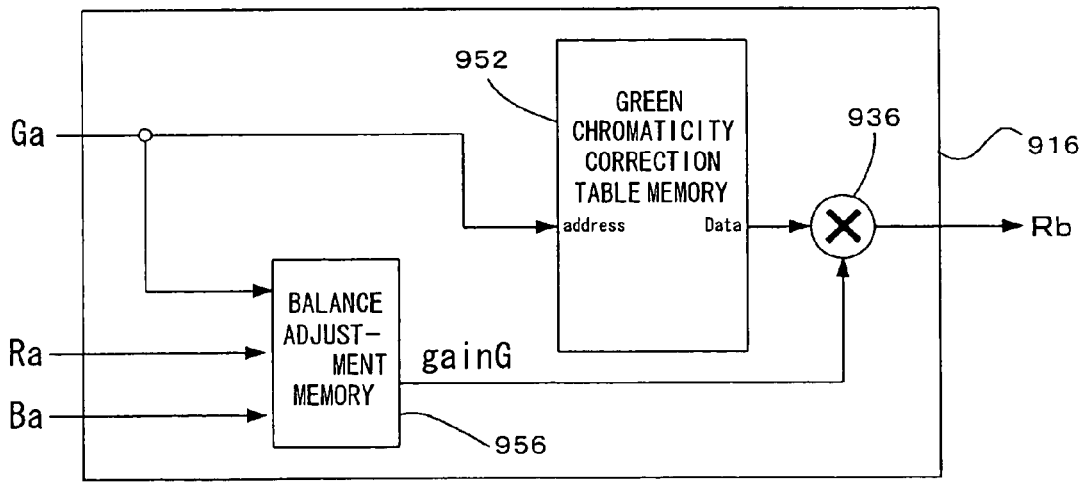

FIG. 11 shows structures of an R chromaticity correction table in which rapid change of hue was prevented, and a G chromaticity correction table. In FIGS. 11A and 11B, balance adjustment memories 955 and 956 output gain R and gain G which are gains according to balance of image data of RGB, respectively, and by multipliers 935 and 936, respective offset values are multiplied with gains, and that multiplication values are outputted from the R chromaticity correction table 915 and the G chromaticity correction table 916, as offset values for use in respective chromaticity point corrections.

The balance adjustment memory 955 of FIG. 11 outputs gain R=1, in case that a ratio of data of RGB was 1:1:1. Also, in case of such a simple color that the ratio of RGB is 1:0:0, gain R=0 is outputted. Also, in case that the ratio of RGB was 2:1:1, gain R=0.5 is outputted. In this manner, according to balance of RGB, gain values of 0 to 1 are stored in the balance adjustment memories 955 and 956. By configuring the R chromaticity correction table and the G chromaticity correction table as described above, it is possible to prevent the rapid change of hue, without narrowing the color reproduction range, and to suppress variation of a chromaticity point. In this embodiment, the balance adjustment memory judges whether or not image data is data showing a simple color, and a gain, which is given to a multiplier as a prohibition unit, is decided, and thereby, addition of the offset value at the time of a simple color is prohibited.

Fourth Embodiment

In a fourth embodiment, downstream the luminescent characteristic correction unit for carrying out saturation correction in accordance with saturation characteristics of respective phosphors, disposed is a chromaticity point correction unit for selecting the offset value in accordance with a value of corrected image data of R and G after saturation correction, so as to stabilize balance of the tristimulus values XYZ, and for adding that offset value to the corrected image data of B after saturation correction. By this, color balance of the tristimulus values XYZ is stabilized regardless of gradation, and correction for suppressing variation of chromaticity of a desired color, in particular, an achromatic color is carried out.

(Color Signal Correction Apparatus)

Figure 12:
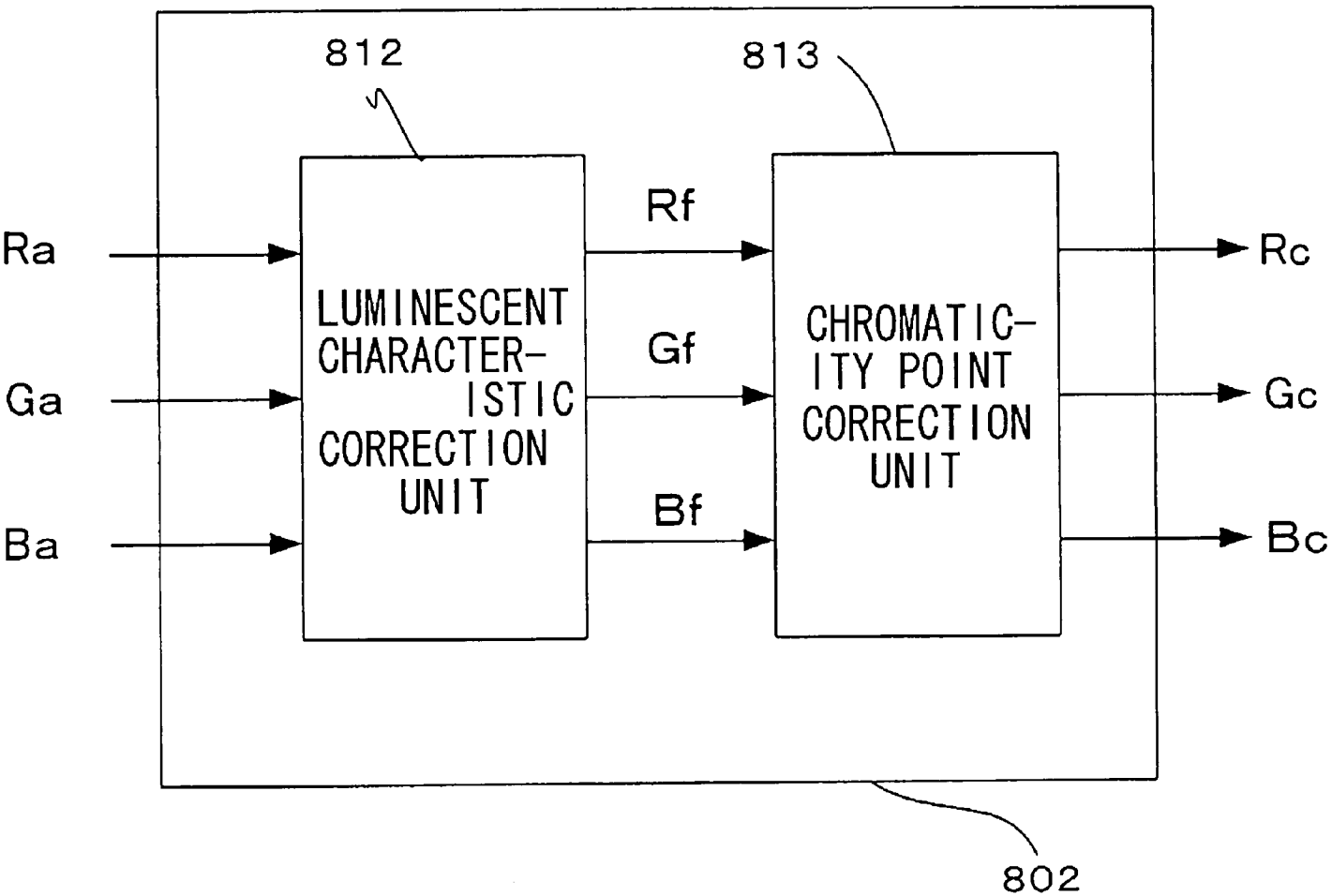
FIG. 12 is a view showing a block diagram of a color signal correction apparatus in a fourth embodiment.
Figure 13:
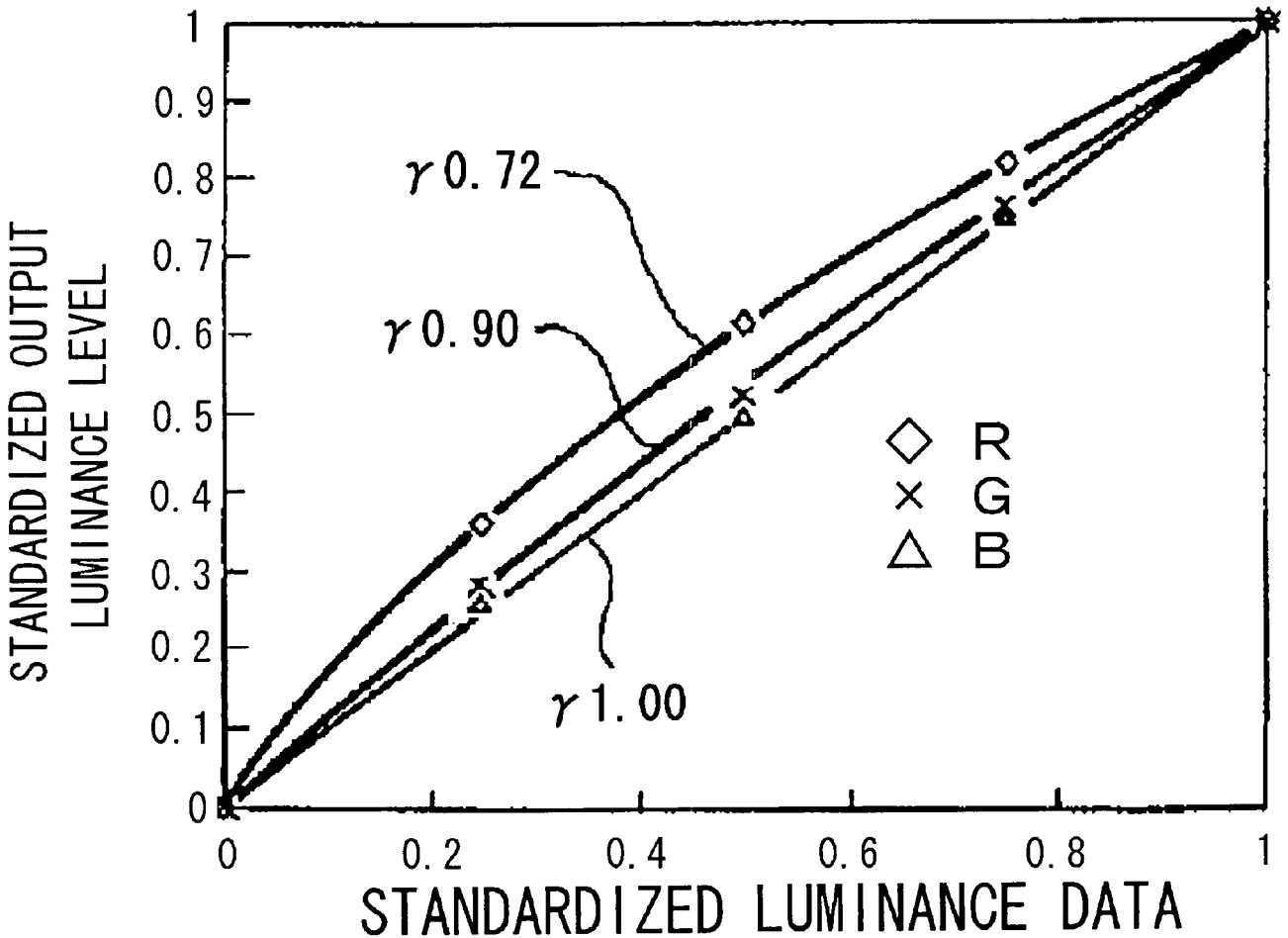
FIG. 13 is a graph showing a conventional light emission luminance characteristic.
Figure 14:
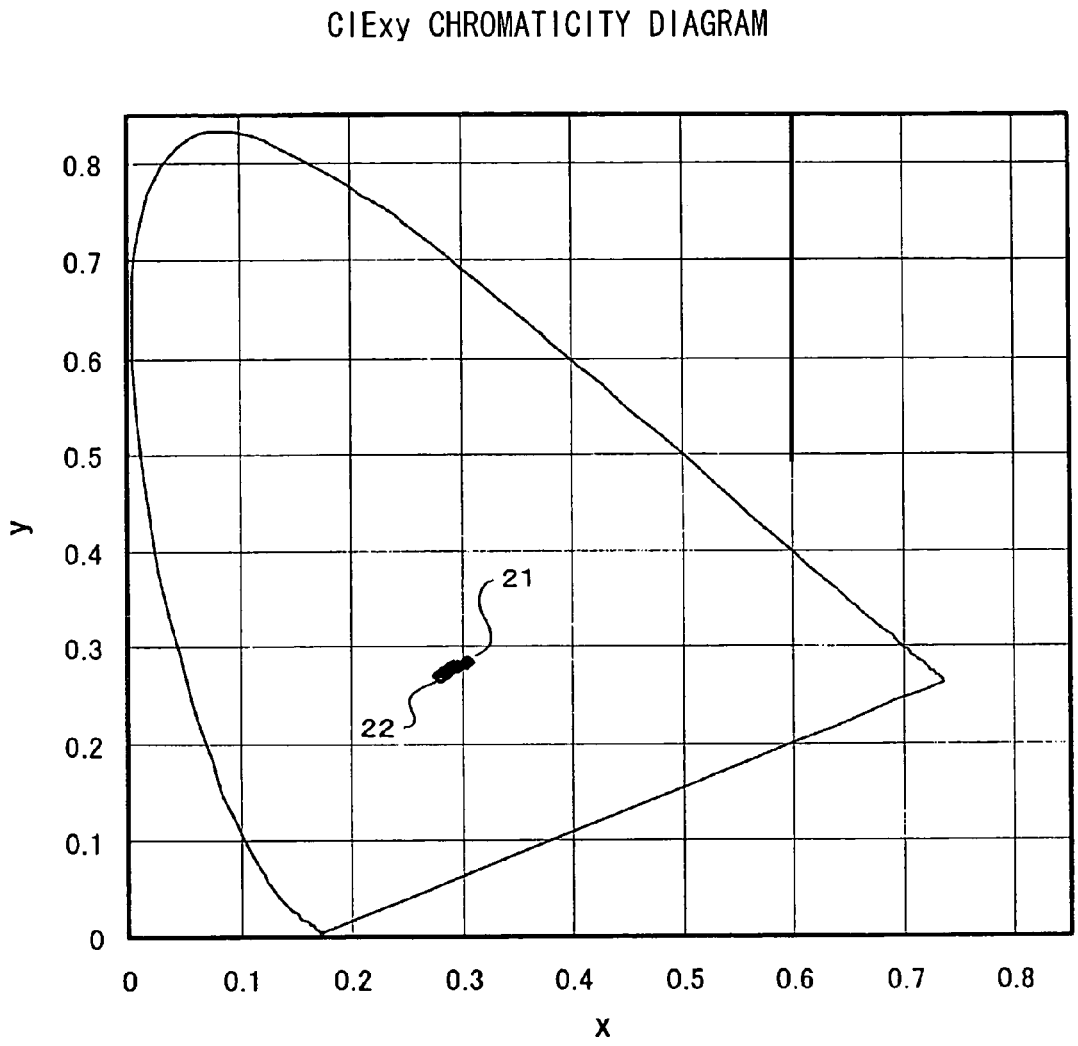
FIG. 14 is a view showing chromaticity point change of a gradation characteristic of an achromatic color, after saturation correction of phosphors.
Figure 15A:
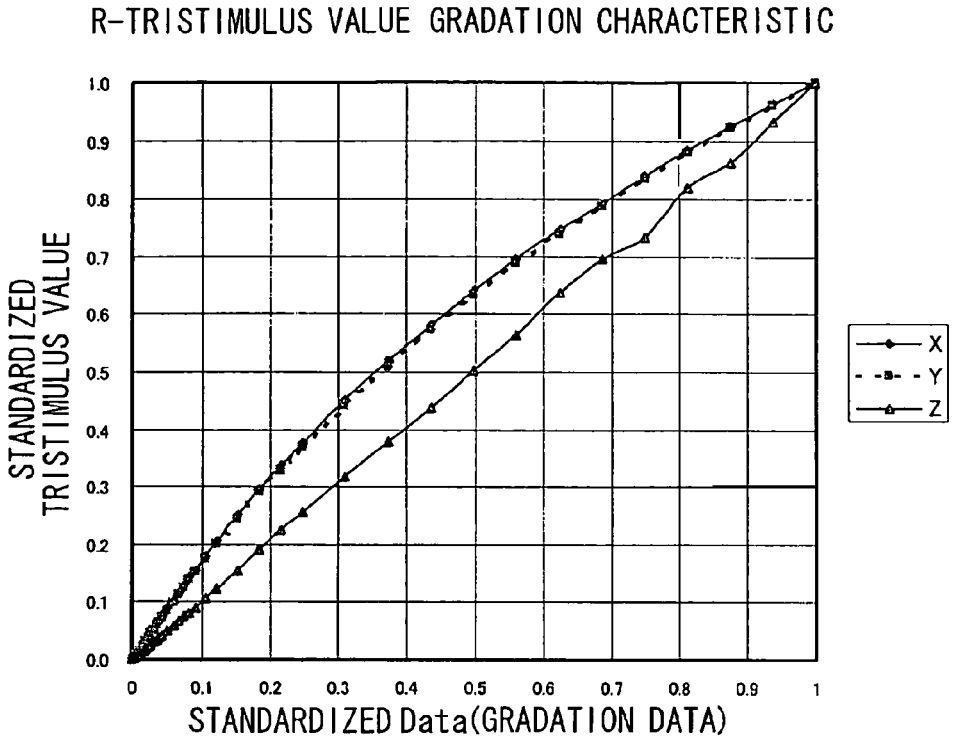
FIGS. 15A and 15B are graphs showing a gradation characteristic of tristimulus values XYZ of red and green phosphors.
Figure 15B:
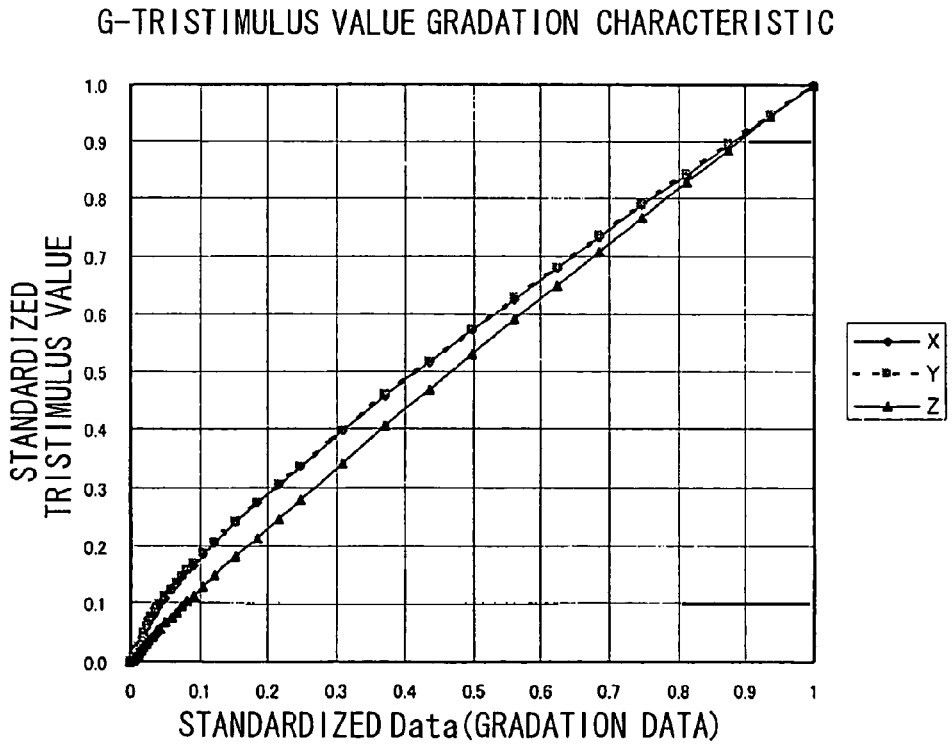
Figure 16A:
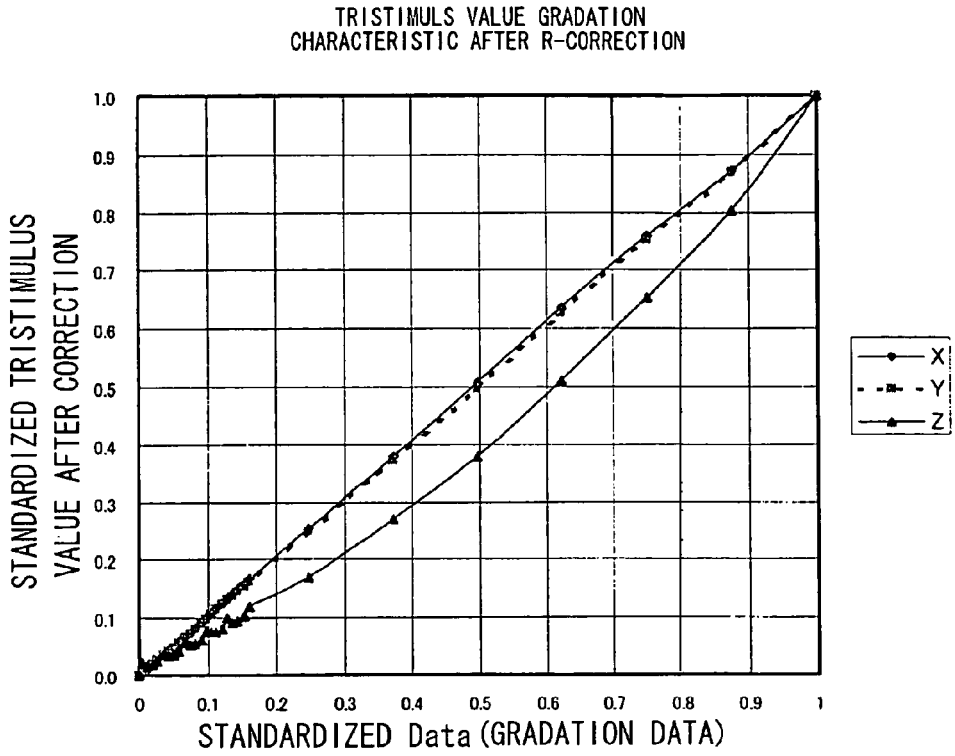
FIGS. 16A and 16B are graphs showing a gradation characteristic of tristimulus value XYZ of saturation correction of red and green phosphors.
Figure 16B:
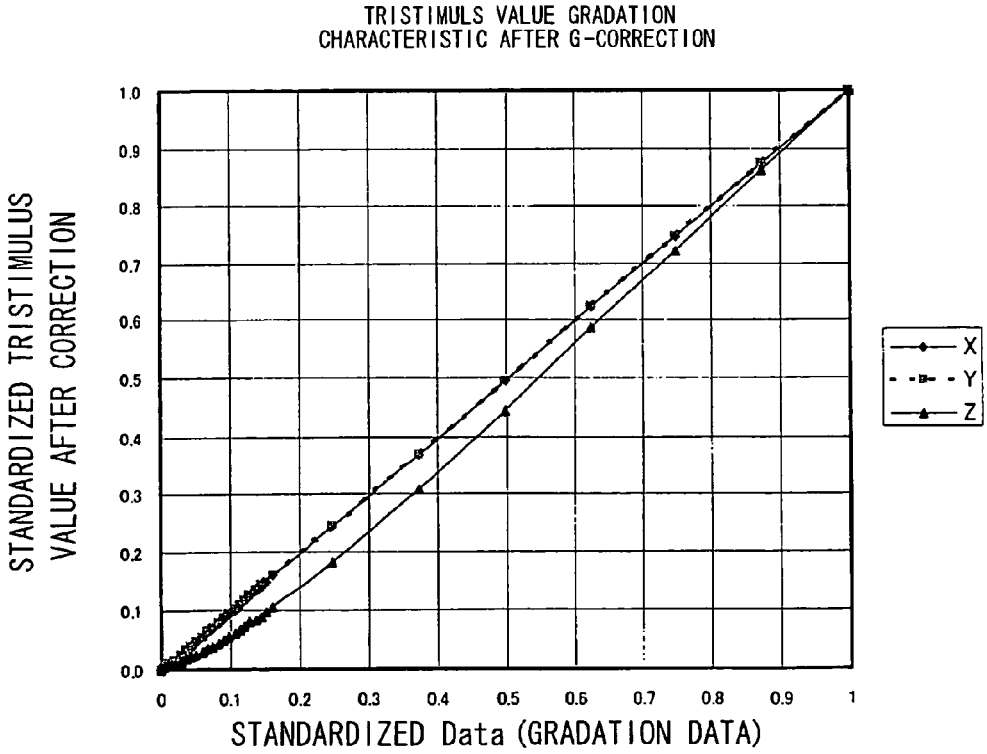

Next, a color signal correction apparatus according to this fourth embodiment will be hereinafter described. FIG. 12 shows a block diagram of the color signal correction apparatus according to this fourth embodiment. Image data Ra, Ga, and Ba are inputted into the luminescent characteristic correction unit 812, and saturation correction is carried out in accordance with saturation characteristics of respective phosphors, and corrected image data Rf, Gf, and Bf are outputted, and transferred to the chromaticity point correction unit 813. In the chromaticity point correction unit 813, the offset value is selected from values of Rf and Gf so as to stabilize balance of the tristimulus values XYZ, and that offset value is added to Bf, and thereby, such a color signal correction apparatus is configured that color balance of the tristimulus values XYZ is stabilized regardless of gradation, and variation of chromaticity of an achromatic color is suppressed.

Also, with regard to the luminescent characteristic correction unit 812, a structure of a table for use in luminescent characteristic correction, the chromaticity point correction unit 813, and preparation of a table of offset values, they are the same as the structure in the first embodiment (see, FIGS. 7, 8, and 1, respectively).

And, the above-described color signal correction apparatus 802 was mounted on an image display apparatus, in the same manner as in the first embodiment, and display of an image was carried out, and as a result of that, in a gradation characteristic of a simple color and an achromatic color, which was a problem in the past, balance of the tristimulus values could be stabilized, and variation of a chromaticity point could be suppressed, by which, it was confirmed that variation of a chromaticity point can be suppressed. Also, it was confirmed that, as to a luminance characteristic, a good characteristic can be obtained, and, further, also as to a natural image, a good image can be obtained.

Also, in this fourth embodiment, the structure which was described in the second and third embodiment can be applicable thereto.

Also, in the fourth embodiment, it was described that the chromaticity point correction table and the luminescent characteristic correction table, which are used in the color signal correction apparatus, are prepared by use of the structure using cold cathode devices, but with regard to the chromaticity point correction table and the luminescent characteristic correction table which are used in the color signal correction apparatus, values of respective tables of the chromaticity point correction table and the luminescent characteristic correction table may be prepared, according to an indicator such as an ELD, a PDP and so on, by measuring their characteristics and so on.

As described above, a color signal correction method according to respective embodiments of this invention can be realized by use of a semiconductor integrated circuit as a functional block, and this can be integrated together with another functional block. In this case, the color signal correction method of this invention can be utilized in an electric data form, as a design resource (IP core) which is described in HDL and can be synthesized logically. Also, the color signal correction method of this invention can be realized by use of software which can be executed by a microprocessor.

As described above, according to this invention, by correcting color signals of respective colors so as to stabilize balance of tristimulus values, variation of a chromaticity point of a simple color which was interlocked with change of a gradation level, and variation of a chromaticity point in a gradation characteristic of an achromatic color, which were problems in the past, could be suppressed.

What is claimed is:

1. A color signal correction apparatus that corrects color signals of red, green, and blue, which correspond to phosphors emitting red, green, and blue light, respectively, the apparatus comprising:

a luminance characteristics correction unit that applies a correction of multiplying each color signal inputted thereto by an inverse function of saturation characteristics of the corresponding phosphor in order that the gradation characteristics of the phosphors become linear; and a chromaticity point correction unit (a) that comprises (1) an offset value calculating unit for calculating an offset value for suppressing variation of a chromaticity due to the correction process by the luminance characteristics correction unit on the basis of an inputted color signal of red and/or an inputted color signal of green, and (2) an offset value addition unit for adding the calculated offset value to an inputted color signal of blue, and (b) that outputs the inputted color signals of red and green and the corrected color signal of blue as output signals, wherein the offset value is relevant to an amount of miss-correction of Z-component in the correction process applied to the inputted color signals of red and/or green by the luminance characteristics correction unit.

2. The color signal correction apparatus according to claim 1, wherein:

output signals from the chromaticity point correction unit are inputted to the luminance characteristics correction unit, or output signals from the luminance characteristics correction unit are inputted to the chromaticity point correction unit.

3. The color signal correction apparatus according to claim 1, wherein the offset value is a value which increases or decreases in a non-linear form, to increase a gradation level of the inputted color signal of blue.

4. The color signal correction apparatus according to claim 1, wherein the chromaticity point correction unit further comprises (a) a second offset value calculating unit for calculating a second offset value to suppress an increase of X-component caused by the offset value addition unit on the basis of the offset value, and (b) a second offset value addition unit for subtracting the calculated second offset value from the inputted color signal of red.

5. The color signal correction apparatus according to claim 1, wherein the chromaticity point correction unit further comprises an offset value adjustment unit for carrying out adjustment of the offset value, in accordance with balance of luminance levels between the color signals.

6. The color signal correction apparatus according to claim 5, wherein the chromaticity point correction unit further comprises a prohibition unit for prohibiting addition of the offset value, in case that it was judged that a color signal representing a simple color was inputted.

7. The color signal correction apparatus according to claim 1, wherein the offset value decision unit determines the offset value in such a manner that the offset value increases and then decreases as a function of a color signal of the color signals.

8. The color signal correction apparatus according to claim 7, wherein the offset value decision unit determines the offset value using a table.

9. The color signal correction apparatus according to claim 7, wherein the offset value increases and then decreases as a function of a gradation level of a color signal of the color signals.

10. The color signal correction apparatus according to claim 7, wherein, based nonlinearly on the inputted color signal of red and the inputted color signal of green, the offset value for the color signal of blue is determined.

11. A color signal correction method for correcting color signals of red, green, and blue, which correspond to phosphors emitting red, green, and blue light, respectively, the method comprising:

a luminance characteristics correction step of applying a correction of multiplying each color signal that is inputted by an inverse function of saturation characteristics of the corresponding phosphor in order that the gradation characteristics of the phosphors become linear; and a chromaticity point correction step (a) that comprises (1) an offset value calculating step for calculating an offset value for suppressing variation of a chromaticity due to the correction process by the luminance characteristics correction step on the basis of an inputted color signal of red and/or an inputted color signal of green, and (2) an offset value addition step of adding the calculated offset value to an inputted color signal of blue, and (b) step that outputs the inputted color signals of red and green. and the corrected color signal of blue, as output signals, wherein the offset value is relevant to an amount of miss-correction of Z-component in the correction process applied to the color signals of red and/or green by the luminance characteristics correction step.

12. An image display apparatus comprising:

a display having an electron source and a phosphor which emits light by irradiation of an electron beam from the electron source; and a color signal correction apparatus that corrects color signals of red, green, and blue, which correspond to phosphors emitting red, green, and blue light, respectively, the color signal correction apparatus comprising (1) a luminance characteristics correction unit that applies a correction of multiplying each color signal inputted thereto by an inverse function of saturation characteristics of the corresponding phosphor in order that the gradation characteristics of the phosphors become linear, and (2) a chromaticity point correction unit (a) that comprises (i) an offset value calculating unit for calculating an offset value for suppressing variation of a chromaticity due to the correction process by the luminance characteristics correction unit on the basis of an inputted color signal of red and/or an inputted color signal of green, and (ii) an offset value addition unit for adding the calculated offset value to an inputted color signal of blue, and (b) that outputs the inputted color signals of red and green and the corrected color signal of blue as output signals, wherein the offset value is relevant to an amount of miss-correction of Z-component in the correction process applied to the inputted color signals of red and/or green by the luminance characteristics correction unit.

13. The image display apparatus according to claim 12, wherein:

output signals from the chromaticity point correction unit are inputted to the luminance characteristics correction unit, or output signals from the luminance characteristics correction unit are inputted to the chromaticity point correction unit.

14. The image display apparatus according to claim 12, wherein the offset value is a value which increases or decreases in a non-linear form, to increase a gradation level of the inputted color signal of blue.

15. The image display apparatus according to claim 12, wherein the chromaticity point correction unit further comprises (a) a second offset value calculating unit for calculating a second offset value to suppress an increase of X-component caused by the offset value addition unit on the basis of the offset value, and (b) the a second offset value addition unit for subtracting the calculated second offset value from the inputted color signal of red.

16. The image display apparatus according to claim 12, wherein the chromaticity point correction unit further comprises an offset value adjustment unit for carrying out adjustment of the offset value, in accordance with balance of luminance levels between the color signals.

17. The image display apparatus according to claim 16, wherein the chromaticity point correction unit further comprises a prohibition unit for prohibiting addition of the offset value, in case that it was judged that a color signal representing a simple color was inputted.

* * * * *